US012595029B2

(12) United States Patent
Cimolai et al.

(10) Patent No.: US 12,595,029 B2
(45) Date of Patent: Apr. 7, 2026

(54) APPARATUS AND METHOD FOR CLEANING THE HULL OF A VESSEL

(71) Applicant: CIMOLAI S.P.A., Rome (IT)

(72) Inventors: Luigi Cimolai, Azzano Decimo (IT); Carmelo Bottecchia, Sacile (IT); Ennio Picco, Budoia (IT); Leo Antonio Colussi, Legnaro (IT); Alessandro Catanzano, Padua (IT); Marco Sciarra, Pordenone (IT); Giorgio Campanile, Pordenone (IT); Marco Colussi, Legnaro (IT); Ivan Mario Alba, Porcia (IT); Matteo Maretto, Padua (IT)

(73) Assignee: CIMOLAI S.P.A., Rome (IT)

( * ) Notice: Subject to any disclaimer, the term of this patent is extended or adjusted under 35 U.S.C. 154(b) by 425 days.

(21) Appl. No.: 18/249,554

(22) PCT Filed: Oct. 8, 2021

(86) PCT No.: PCT/IB2021/059230
§ 371 (c)(1),
(2) Date: Apr. 19, 2023

(87) PCT Pub. No.: WO2022/084787
PCT Pub. Date: Apr. 28, 2022

(65) Prior Publication Data

US 2023/0382503 A1 Nov. 30, 2023

(30) Foreign Application Priority Data

Oct. 19, 2020 (IT) ..... 102020000024553

(51) Int. Cl.
*B63B 59/08* (2006.01)

(52) U.S. Cl.
CPC ..... *B63B 59/08* (2013.01); *B63B 2059/087* (2013.01); *B63B 2207/02* (2013.01)

(58) Field of Classification Search
CPC ..... B63B 59/08
See application file for complete search history.

(56) References Cited

U.S. PATENT DOCUMENTS 3,227,124 A * 1/1966 Campbell ..... B63B 59/08 15/88.4
4,102,290 A * 7/1978 Weiss ..... B63B 59/08 15/24

(Continued)

FOREIGN PATENT DOCUMENTS

DE 202019003386 U1 9/2019
JP S52 123100 A 10/1977

(Continued)

OTHER PUBLICATIONS

Translation of NL-1010114 generated 2025 (Year: 2025).*

(Continued)

*Primary Examiner* — Eldon T Brockman
(74) *Attorney, Agent, or Firm* — Merchant & Gould P.C.

(57) ABSTRACT

An apparatus and a method for cleaning the hull of a vessel include a washing unit having a plurality of washing modules of the hull, suitable for washing the hull in a submerged configuration. Each washing module is equipped with mobile connectors for the mobile mechanical connection of one washing module to an adjacent washing module, to allow a reciprocal movement between the adjacent washing modules during washing and/or movement. Each washing module has washers of the hull suitable for scraping dirt from the hull. Each washing module is equipped with drivers to allow the positioning and movement of the washing (Continued)

module with respect to the hull and/or with respect to other washing modules during the cleaning of the hull.

18 Claims, 22 Drawing Sheets

(56) References Cited

U.S. PATENT DOCUMENTS

| | | | | |
|---|---|---|---|---|
| 4,843,995 | A | 7/1989 | Bingham | |
| 5,222,452 | A * | 6/1993 | Maloney | B63B 59/08 114/222 |
| 5,431,122 | A | 7/1995 | Templet, Jr. | |
| 10,342,326 | B2 * | 7/2019 | Outa | A46B 13/008 |
| 2017/0347788 | A1 * | 12/2017 | Outa | B08B 9/023 |
| 2019/0039701 | A1 | 2/2019 | Garcia Diaz | |
| 2020/0102058 | A1 | 4/2020 | Bardelli | |

FOREIGN PATENT DOCUMENTS

| | | | | |
|---|---|---|---|---|
| JP | 2003 095190 | A | 4/2003 | |
| JP | 4711572 | B2 * | 6/2011 | B63B 59/08 |
| NL | 1010114 | C2 * | 3/2000 | B63B 59/08 |
| WO | 1991/18785 | A1 | 12/1991 | |

OTHER PUBLICATIONS

Chinese Office Action received for CN Application No. 202180085740.8 on Jul. 19, 2025, 21 pgs.
International Search Report and Written Opinion received for PCT Serial No. PCT/IB2021/059230 on Dec. 20, 2021, 15 pgs.
Italian Search Report received for Italian Serial No. 2020 000024553 on Jun. 8, 2021, 2 pgs.
United Arab Emirates Office Action received for UAE Application No. P6000905/2023 on May 15, 2025, 9 pgs.

* cited by examiner

APPARATUS AND METHOD FOR CLEANING THE HULL OF A VESSEL

CROSS-REFERENCE TO RELATED APPLICATIONS

This application is a National Stage Application of PCT/IB2021/059230, filed Oct. 8, 2021, which claims benefit of Serial No. 10 2020 000024553, filed Oct. 19, 2020, in Italy, and which applications are incorporated herein by reference. To the extent appropriate, a claim of priority is made to each of the above disclosed applications.

FIELD OF APPLICATION

The present invention relates to an apparatus and a method for cleaning the hull of a vessel.

PRIOR ART

As is known, the hulls of vessels over time, at the submerged part thereof, tend to become dirty with algae and other organisms that form actual encrustations. Such incrustations cause a not negligible worsening of the hydrodynamics of the hull since they disturb the flow lines of the water that laps the hull during navigation. This worsening is reflected in the fuel consumption of the vessel and, within certain limits, also in its maneuverability and noise and comfort in navigation.

For these reasons, at predetermined time intervals, the hulls of vessels need to be cleaned, i.e. deprived of such encrustations.

The cleaning operations, except in cases in which maintenance and storage operations are carried out, are performed in water, i.e. with the hull in partial immersion.

For these reasons they are usually carried out by hand by divers using brushes or manually directed and guided water jets.

This cleaning method is not without drawbacks; in fact it is first of all slow and expensive, especially if it is necessary to clean up hulls having dimensions of thousands of square meters.

The costs are double because they concern not only the cost of the actual cleaning operation but also the inevitable costs due to the vessel being stopped pending the completion of the cleaning itself.

Furthermore, in manual operations the dirt detached from the hull is inevitably dispersed in the water; in this way there is a risk of polluting the seabed of the port areas, where these operations are usually carried out.

In order to obviate, at least partially, these drawbacks, there are also apparatuses for automatic cleaning of the hulls of vessels which provide a hollow structure provided with cleaning devices which is hooked to the hull of the ship.

However, these solutions are extremely expensive and difficult to implement; furthermore, the steps of approach/coupling to the hull are particularly complex and risky because they may easily lead to damage to the hull, especially in the event of wave motion.

DISCLOSURE OF THE INVENTION

Thus, there is a need to resolve the cited drawbacks and limitations in reference to the prior art.

This need is met by an apparatus for cleaning the hull of a vessel and by a method.

DESCRIPTION OF THE DRAWINGS

Further features and advantages of the present invention will become more apparent from the following description of preferred and non-limiting embodiments thereof, in which.

Figure 1:
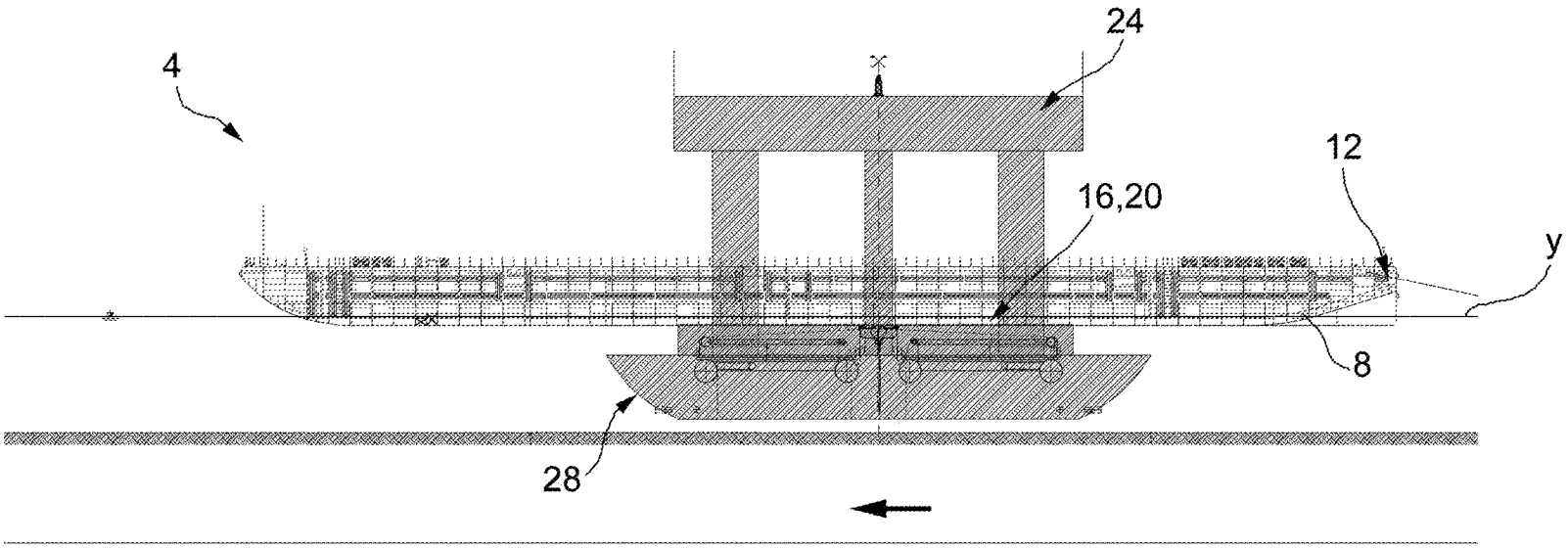
FIG. 1 shows a longitudinal sectional view of an apparatus for cleaning the hull of a vessel according to an embodiment of the present invention.
Figure 2:
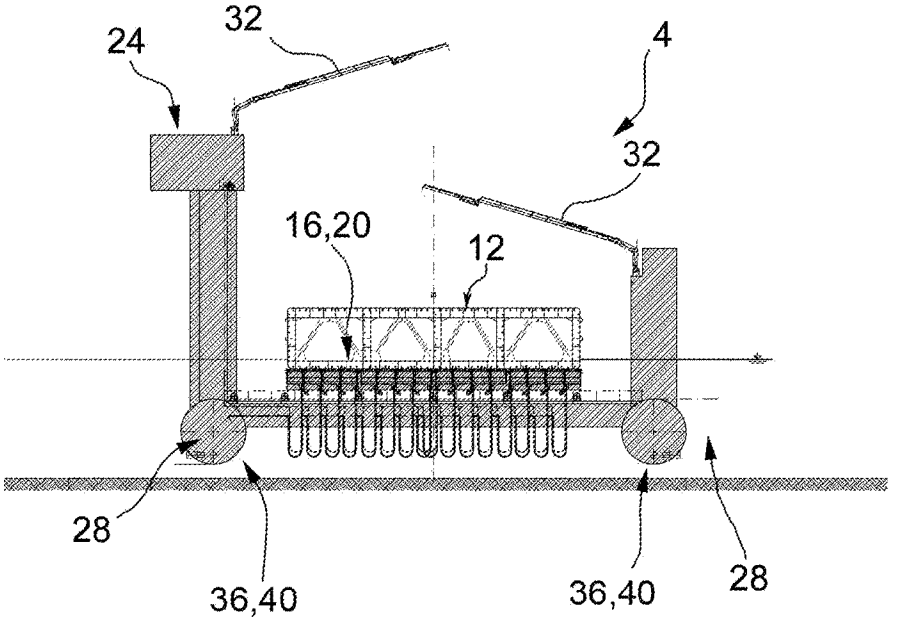
FIG. 2 shows a cross-sectional view of the apparatus for cleaning the hull of a vessel of FIG. 1.
Figure 3:
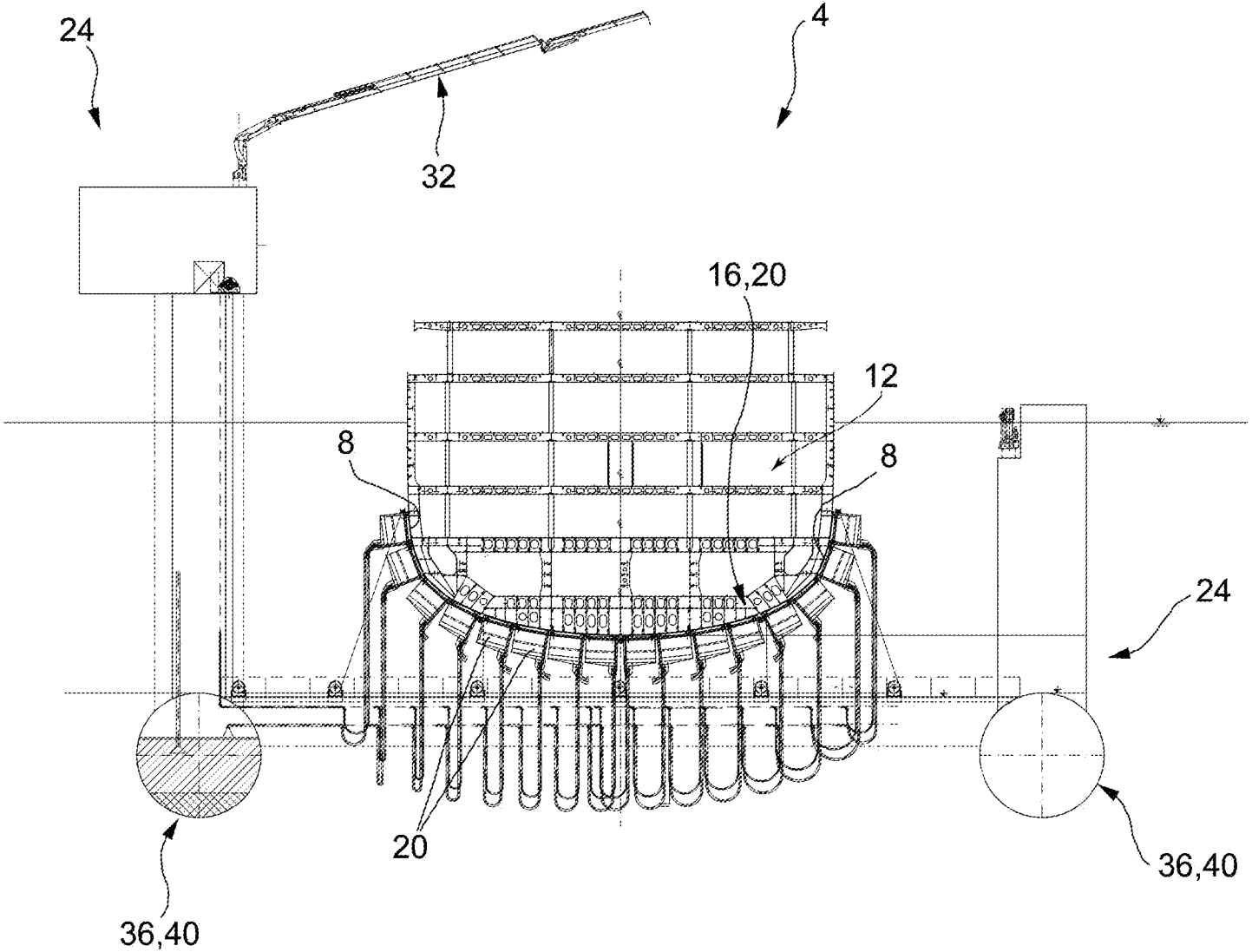
FIG. 3 shows a cross-sectional view of the apparatus for cleaning the hull of a vessel of FIG. 1, in working condition with maximum immersion.
Figure 4:
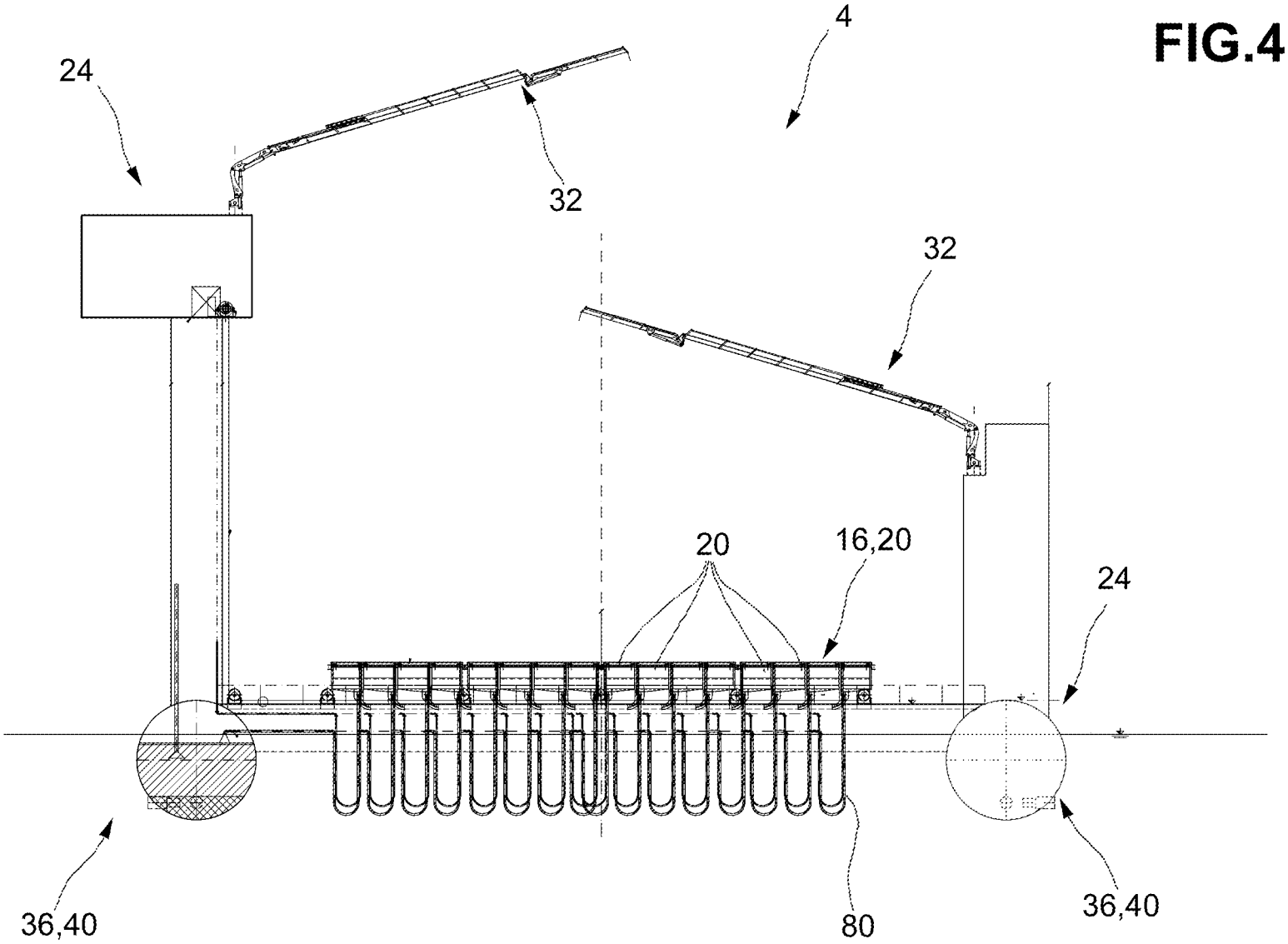
FIG. 4 shows a cross-sectional view of the apparatus for cleaning the hull of a vessel of FIG. 1, in navigation position.
Figure 5:
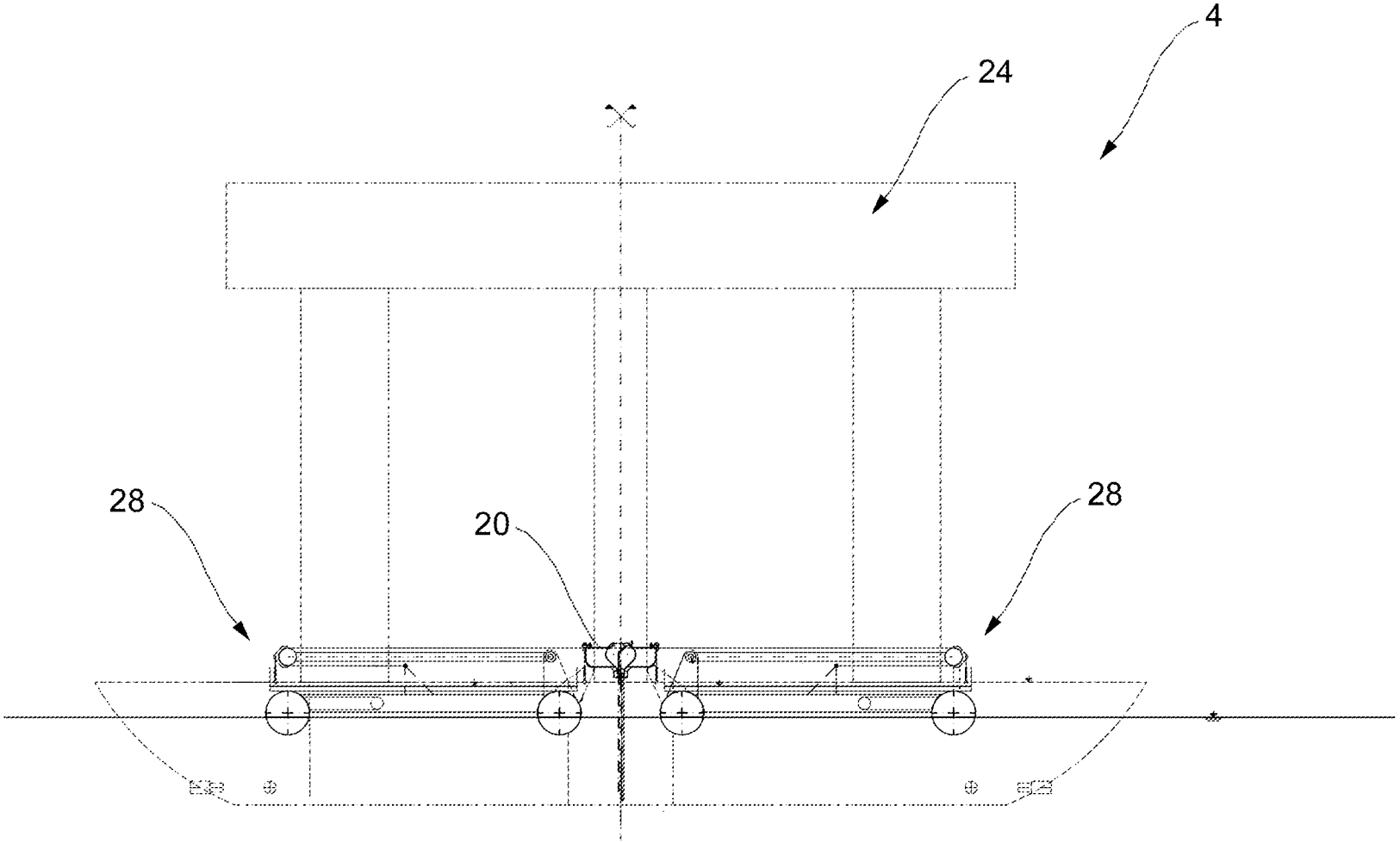
FIG. 5 shows a longitudinal view of the apparatus for cleaning the hull of a vessel of FIG. 1, in navigation position.
Figure 6:
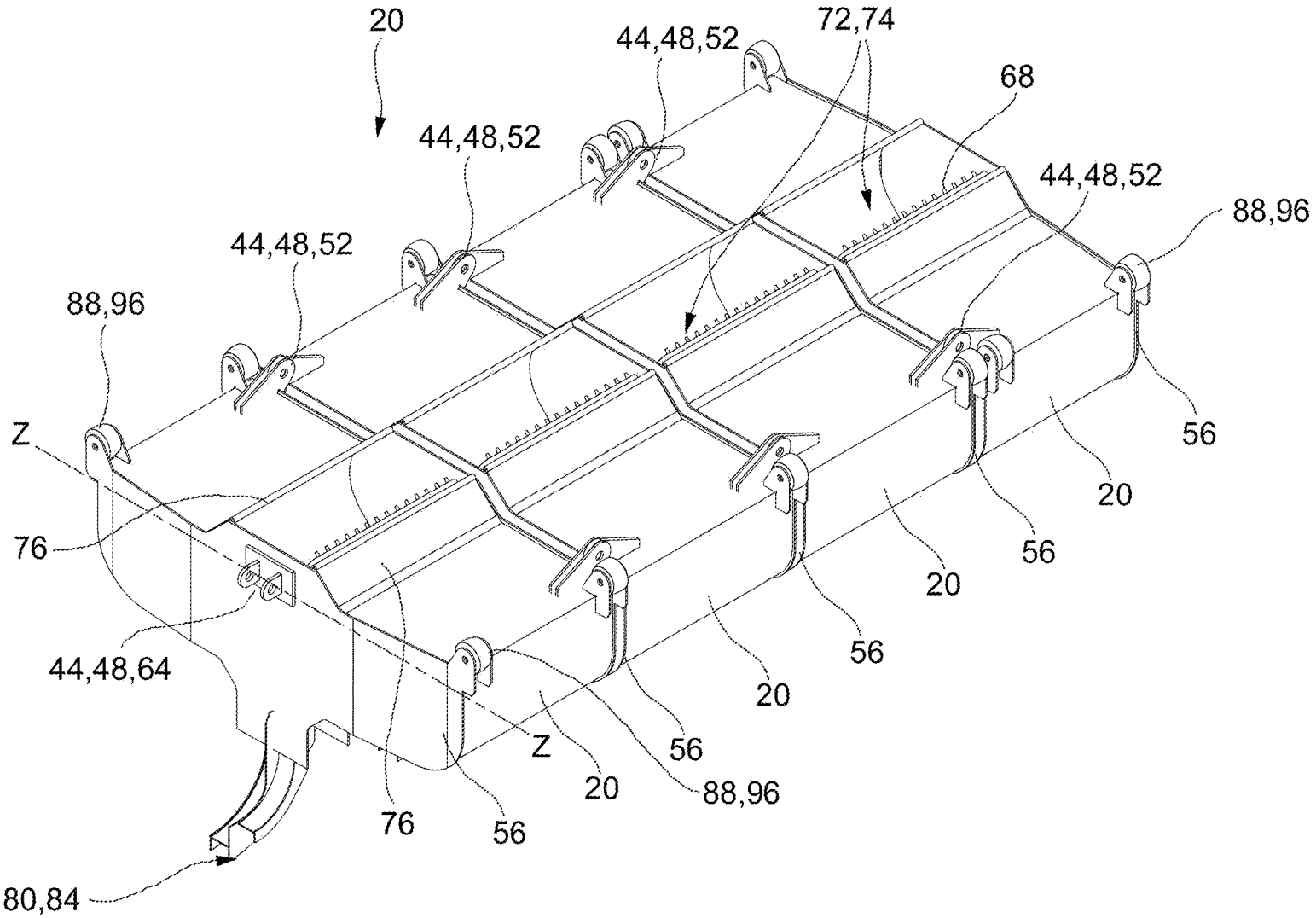
FIG. 6 shows a perspective view of a washing module of the apparatus for cleaning the hull of a vessel according to a possible embodiment of the present invention.
Figure 7A:
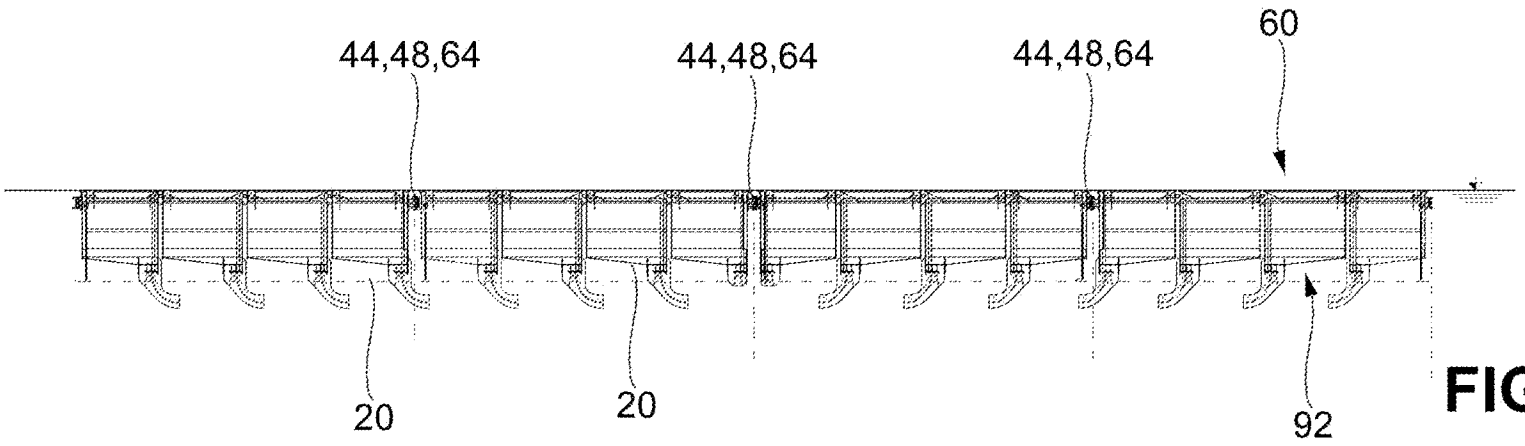
FIGS. 7*a*-7*b* show a side and plan view, respectively, of a set of washing modules according to a possible embodiment of the present invention.
Figure 7B:
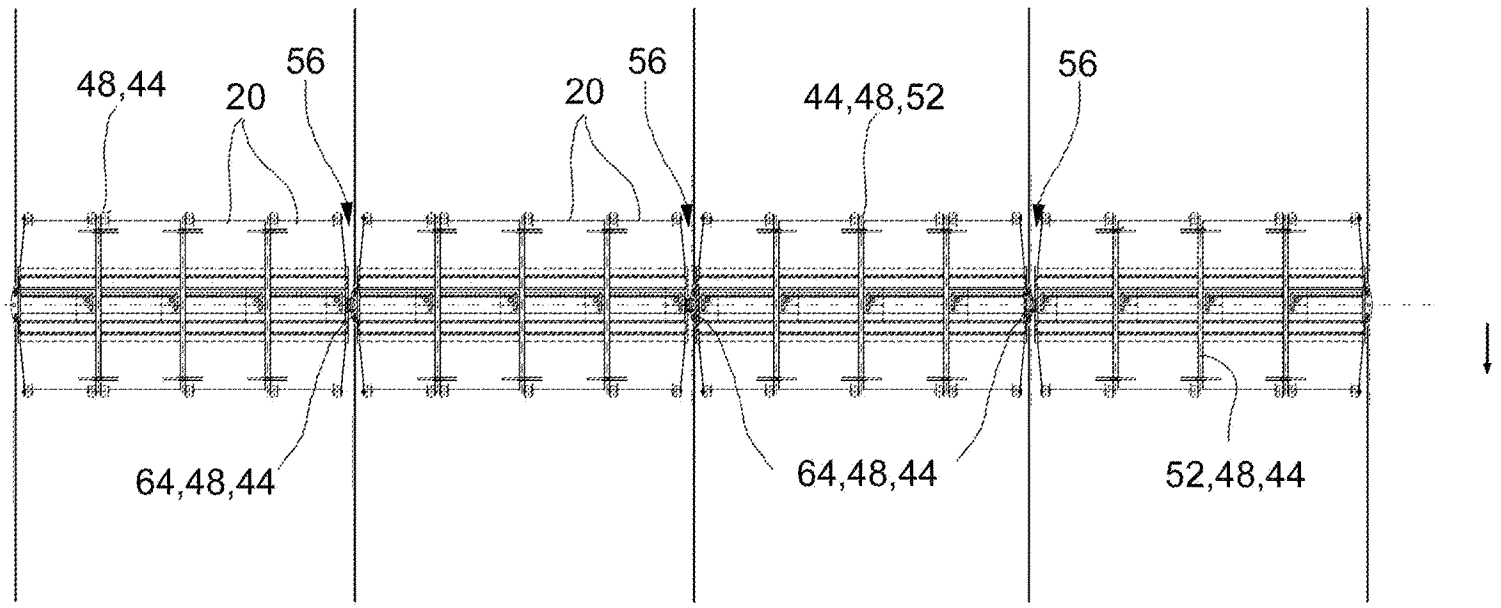
Figure 8:
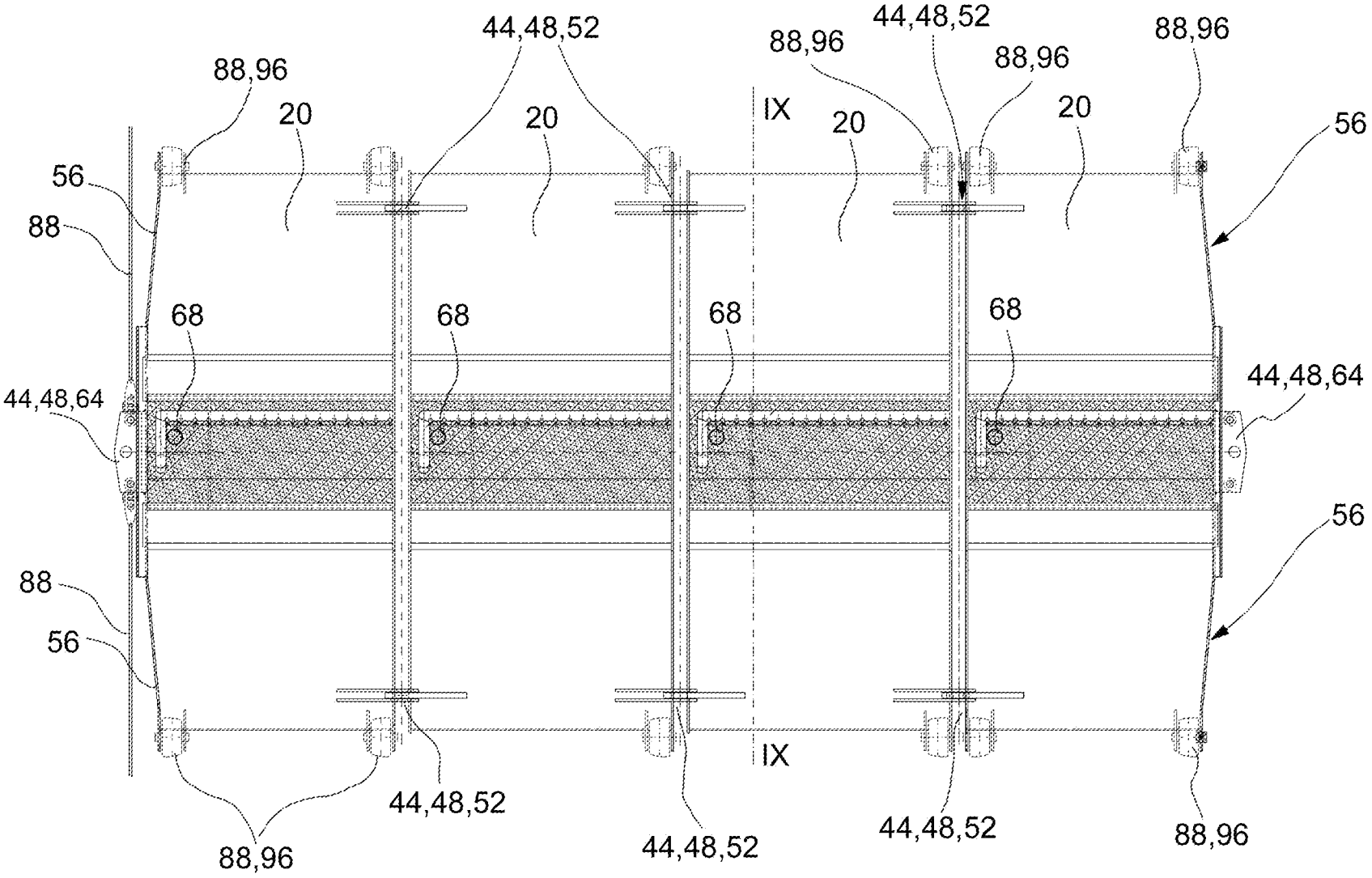
FIG. 8 shows a plan view of washing modules according to a possible embodiment of the present invention.
Figure 9:
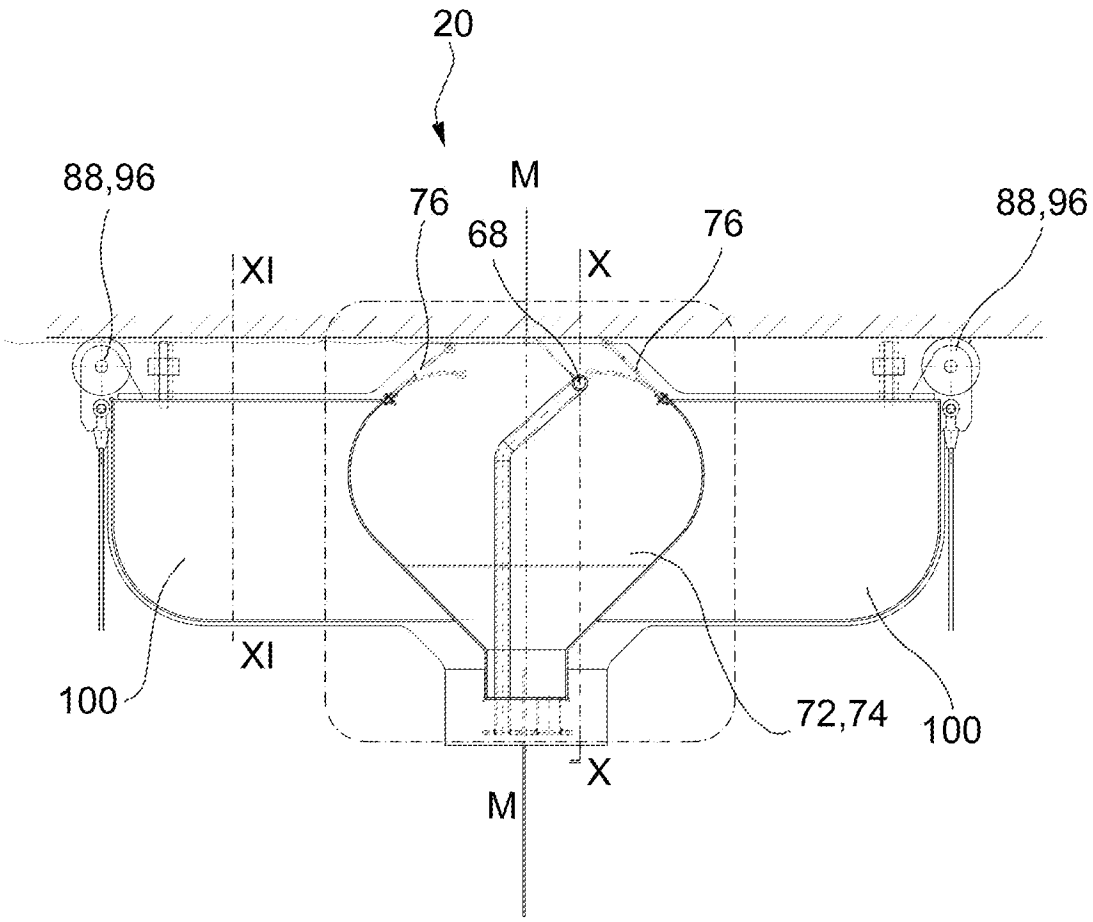
FIG. 9 shows a sectional view of the washing modules of FIG. 8, along the section plane IX-IX of FIG. 8.
Figures 10, 11:
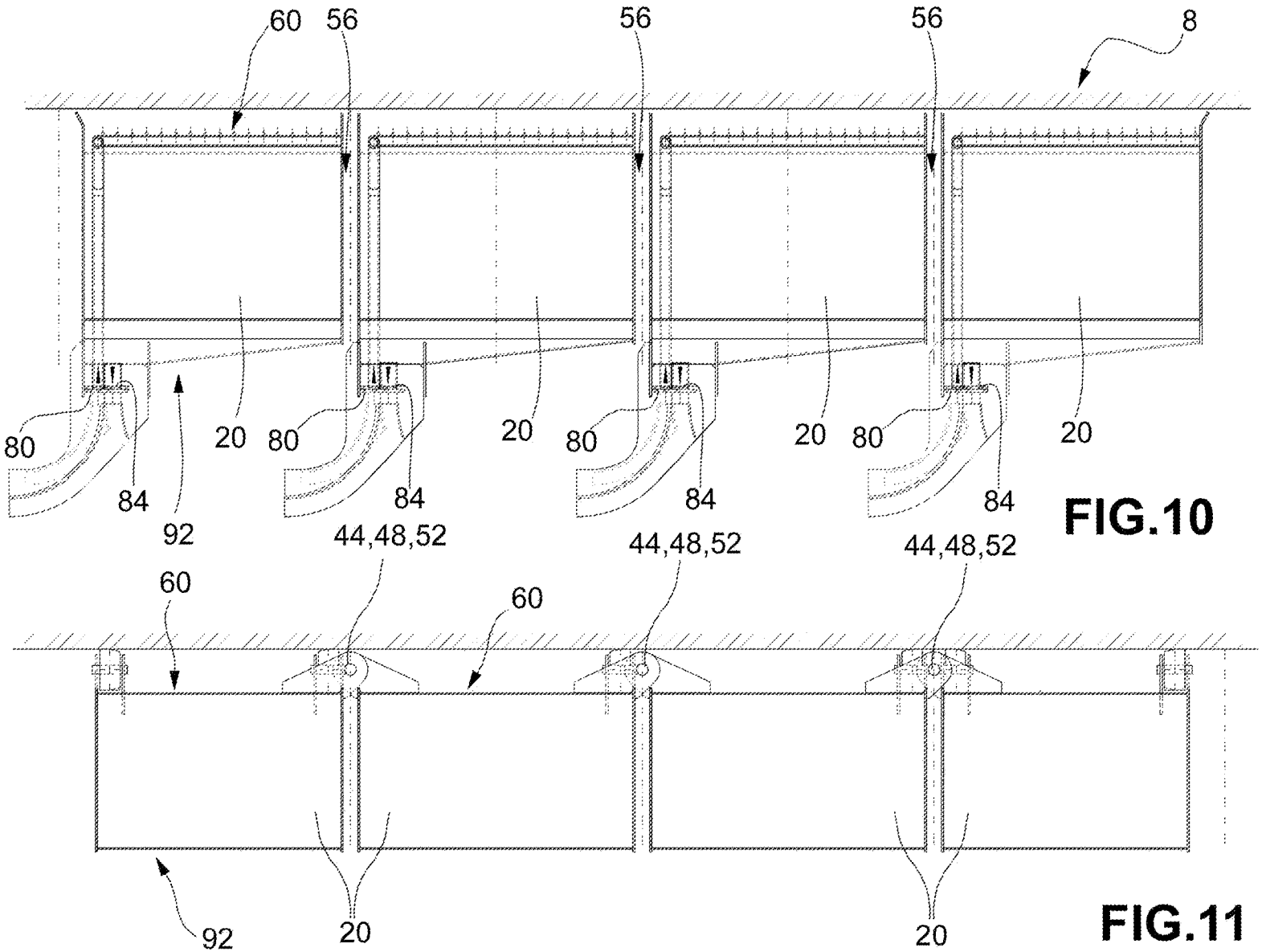
FIG. 10 shows a sectional view of the washing modules of FIG. 9, along the section plane X-X indicated in FIG. 9.
FIG. 11 shows a sectional view of the washing modules of FIG. 8, along the section plane XI-XI indicated in FIG. 9.
Figure 13:
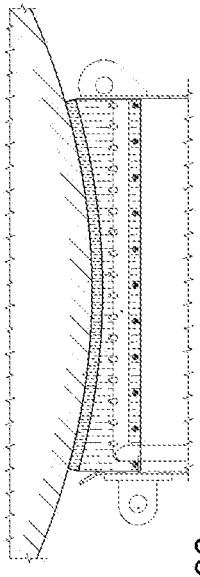
FIG. 13 shows a sectional view of the module of FIG. 12, along the section plane XIII-XIII of FIG. 12.
Figure 13:
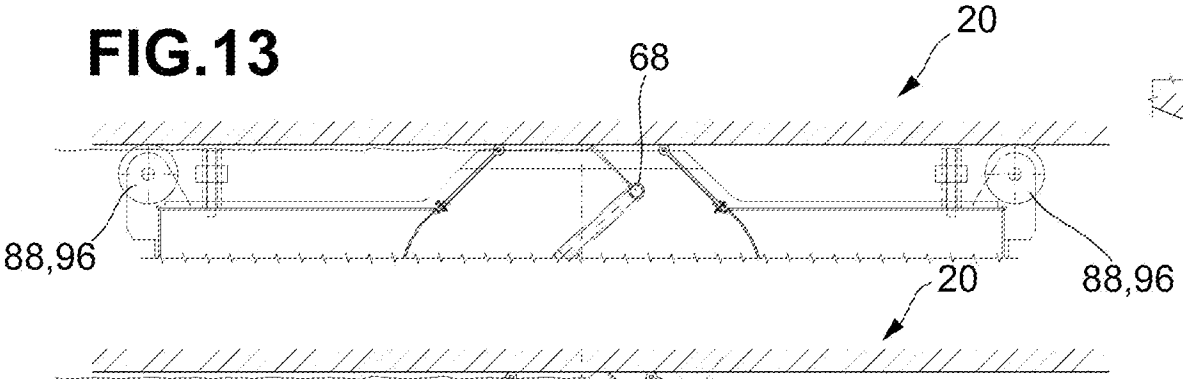
Figure 14:
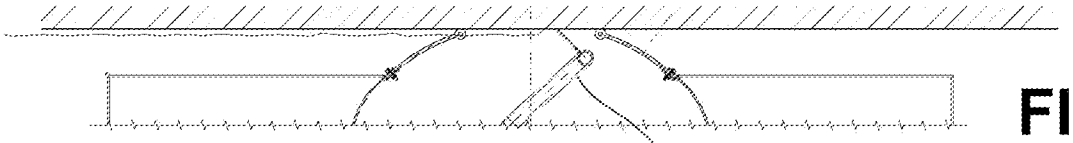
FIG. 14 shows a sectional view of the module of FIG. 12, along the section plane XIV-XIV of FIG. 12.
Figure 12:
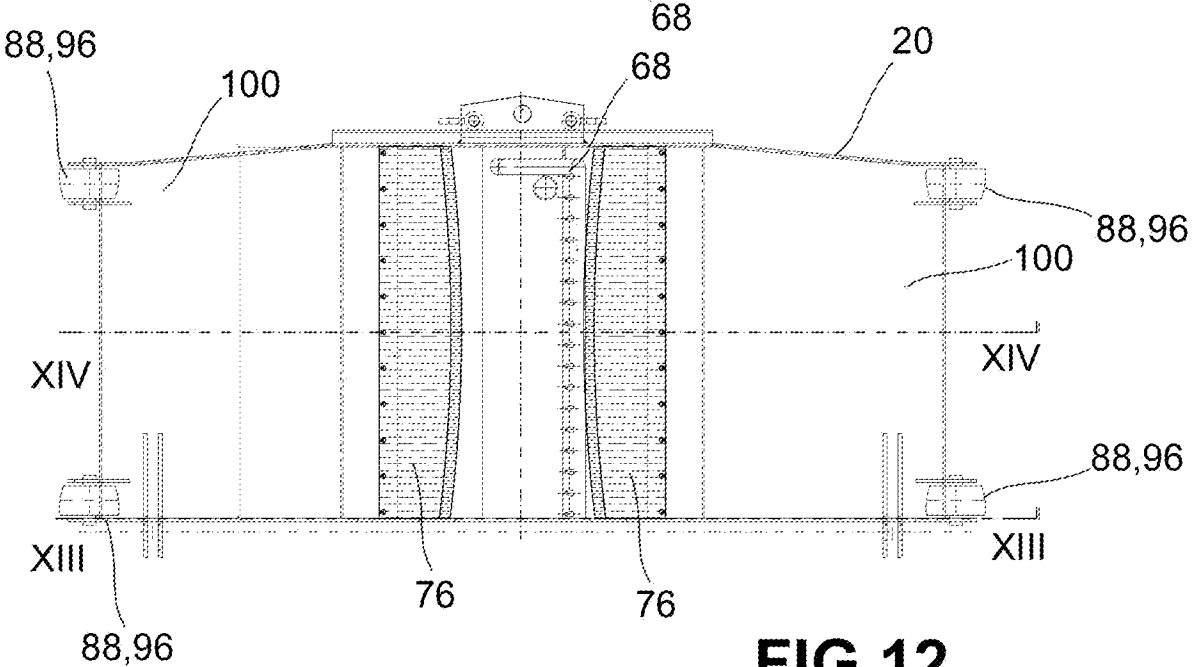
FIG. 12 shows a plan view of the flexible seals of a washing module of the present invention.
Figure 15:
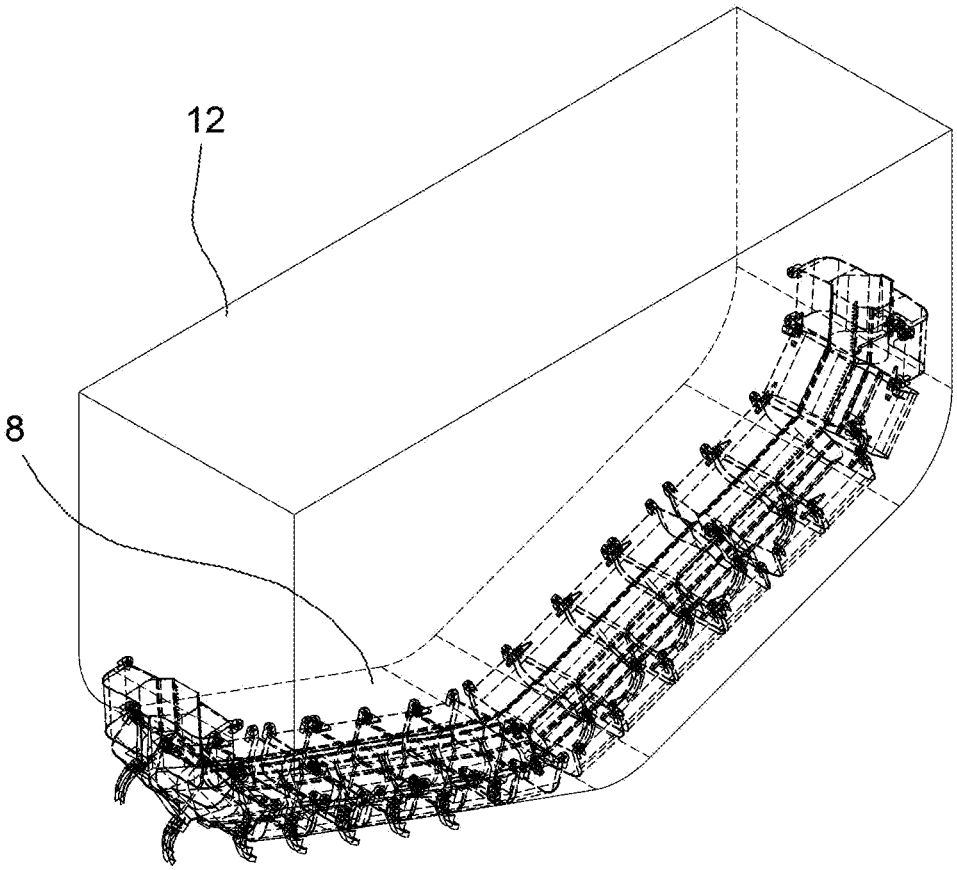
FIGS. 15-16 show perspective and front views of washing modules associated with vessels having different hull geometries.
Figure 15:
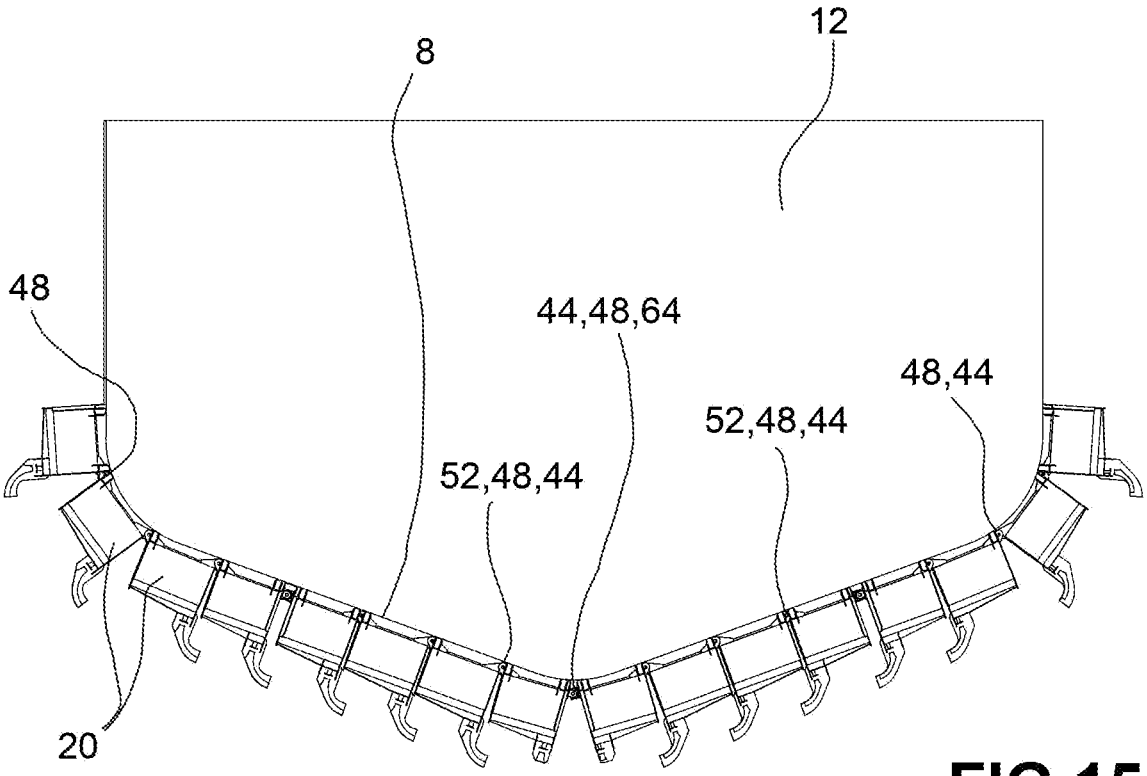
Figure 16:
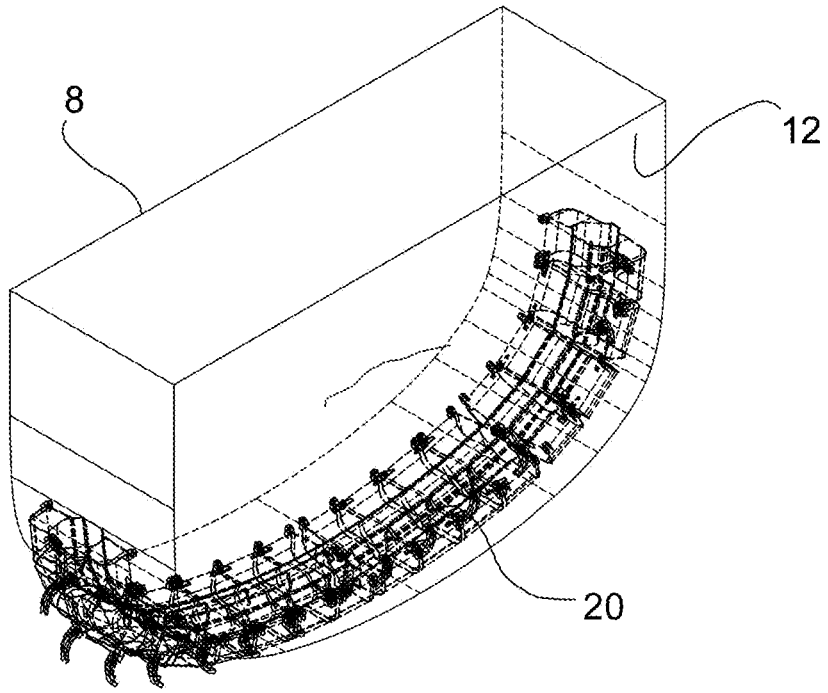
Figure 16:
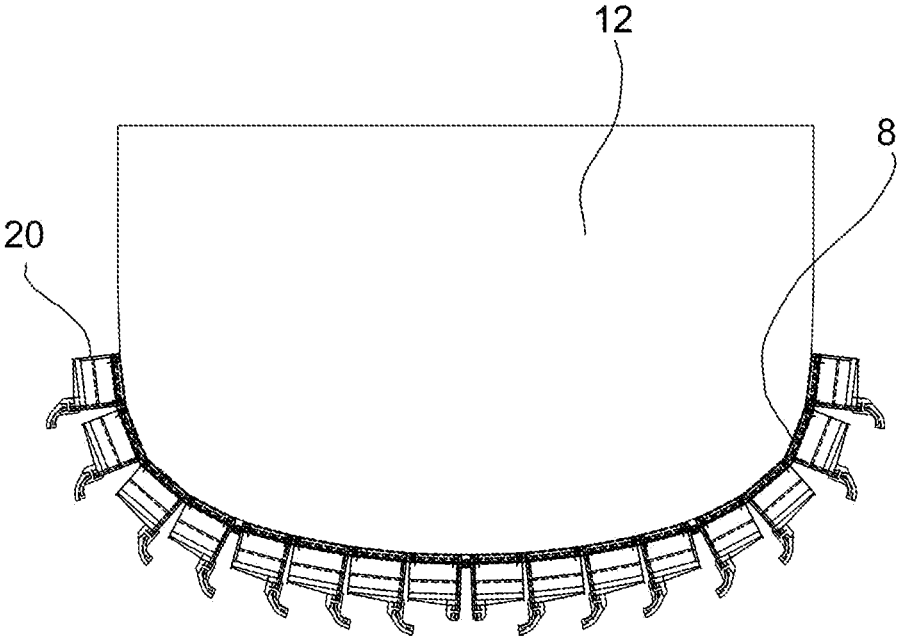
Figure 17:
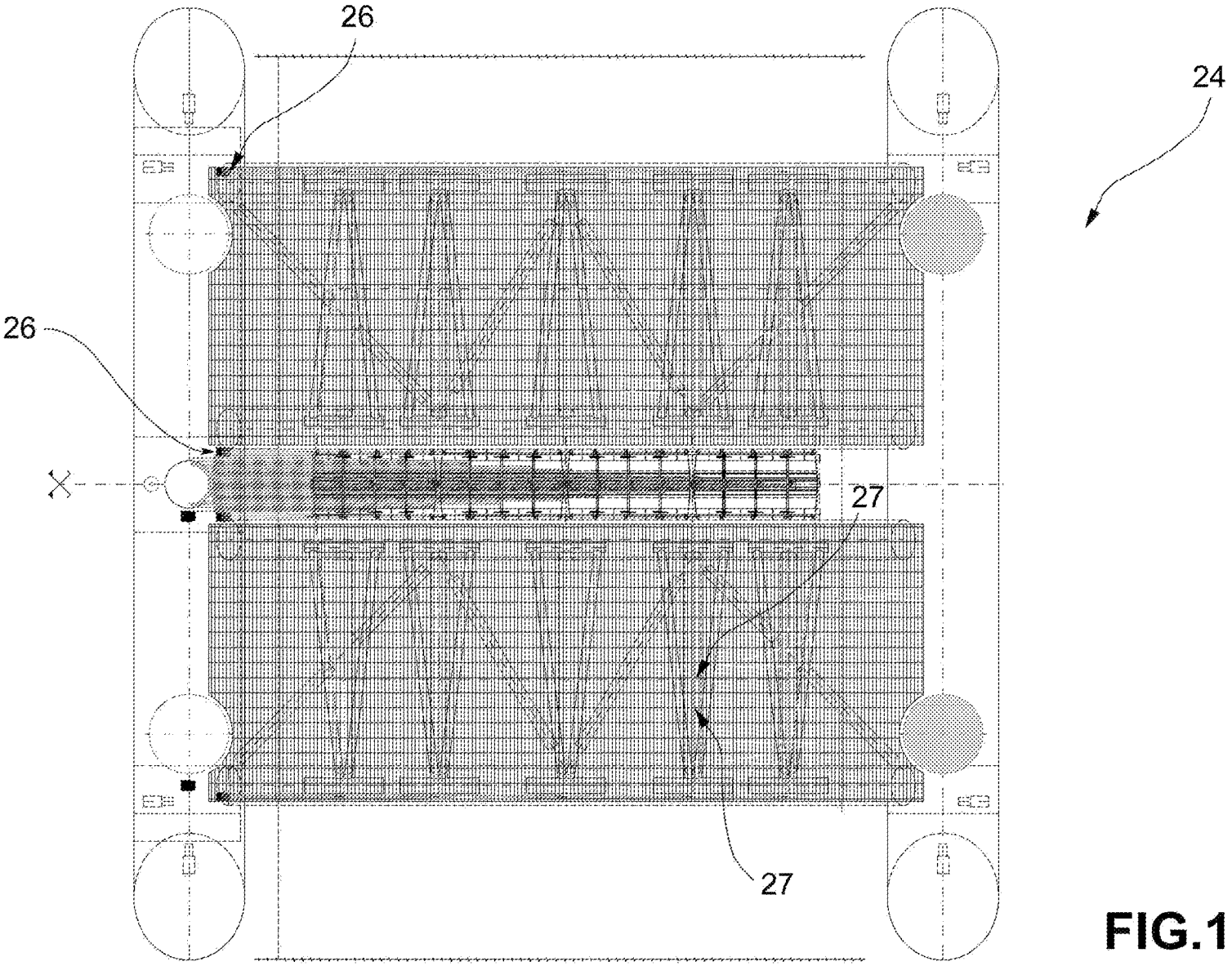
FIG. 17 shows a plan view, in working position with minimum immersion, of the cleaning apparatus according to an embodiment of the present invention.
Figure 18:
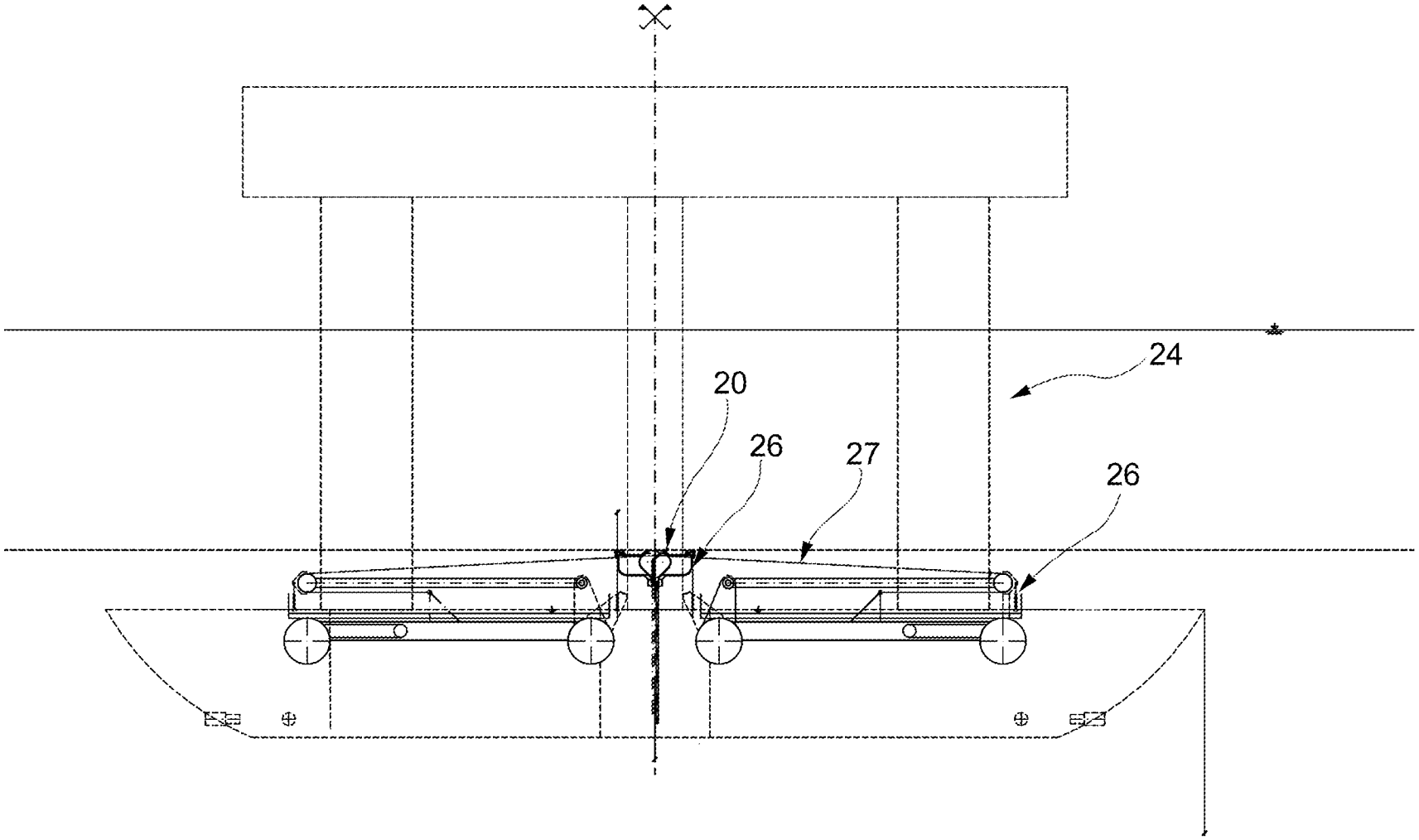
FIGS. 18-19 show sectional views, in working position with maximum immersion, of the cleaning apparatus according to possible embodiments of the present invention.
Figure 19:
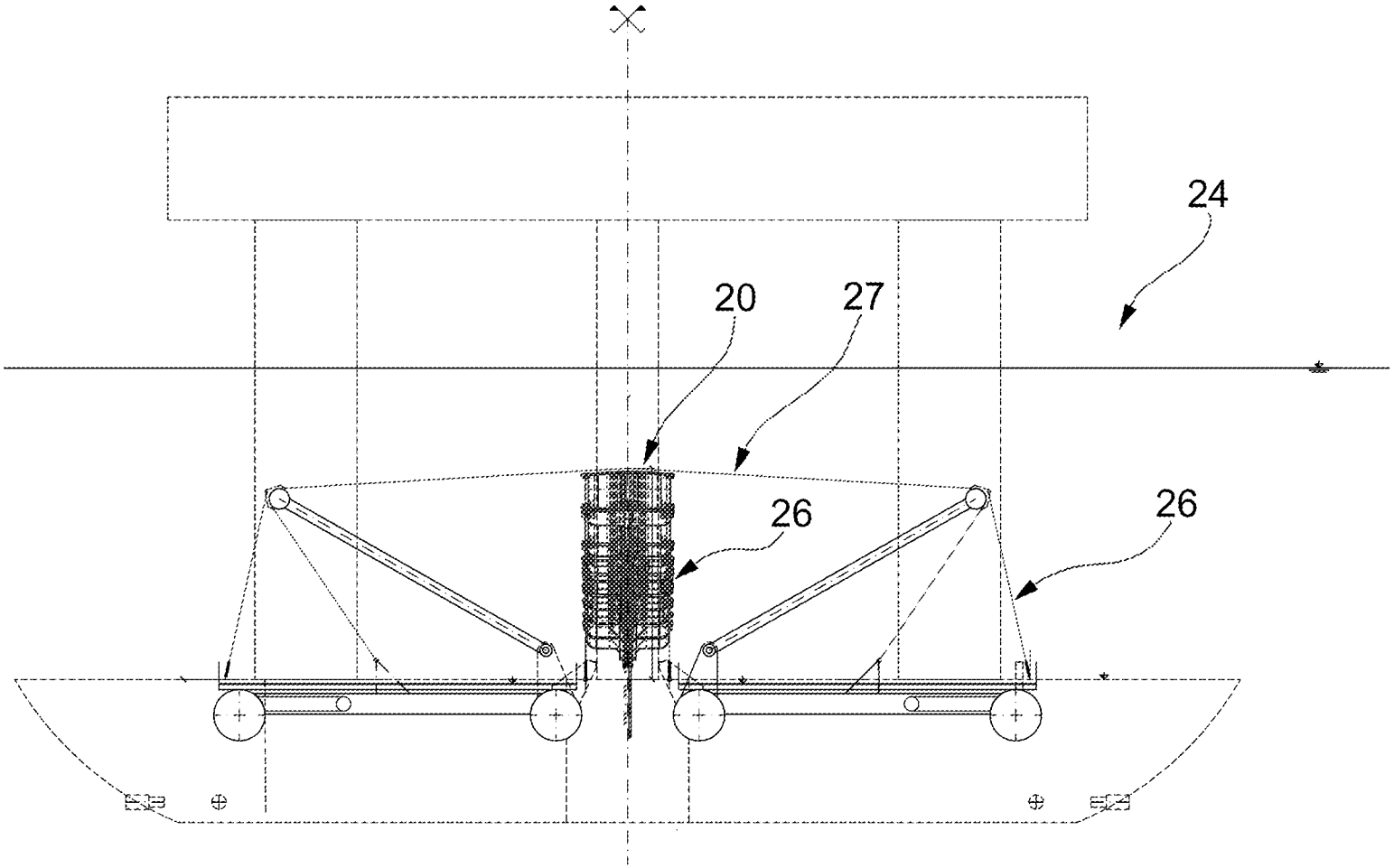
Figure 20:
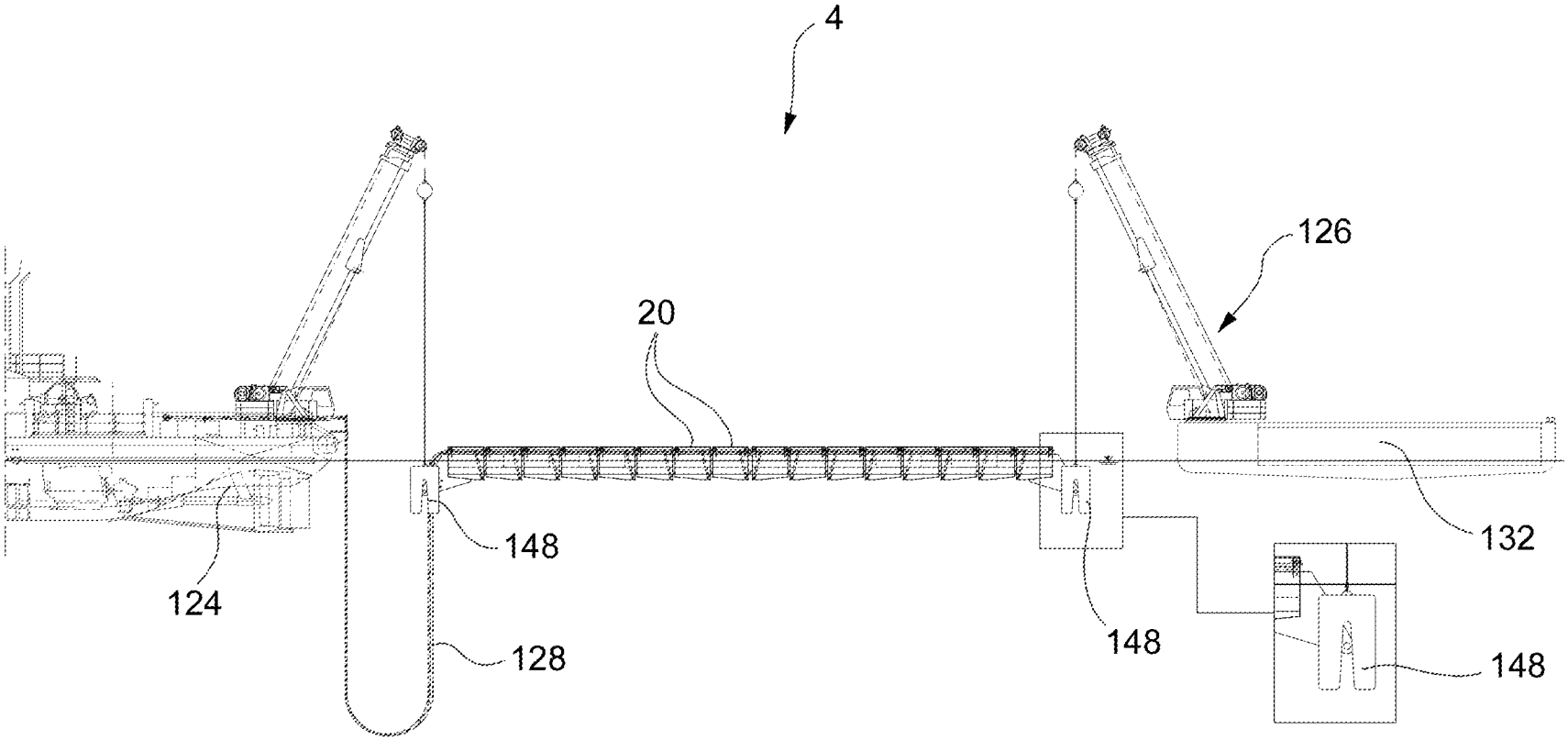
FIGS. 20-24 show sectional views of a cleaning apparatus according to a further embodiment of the present invention.
Figure 21:
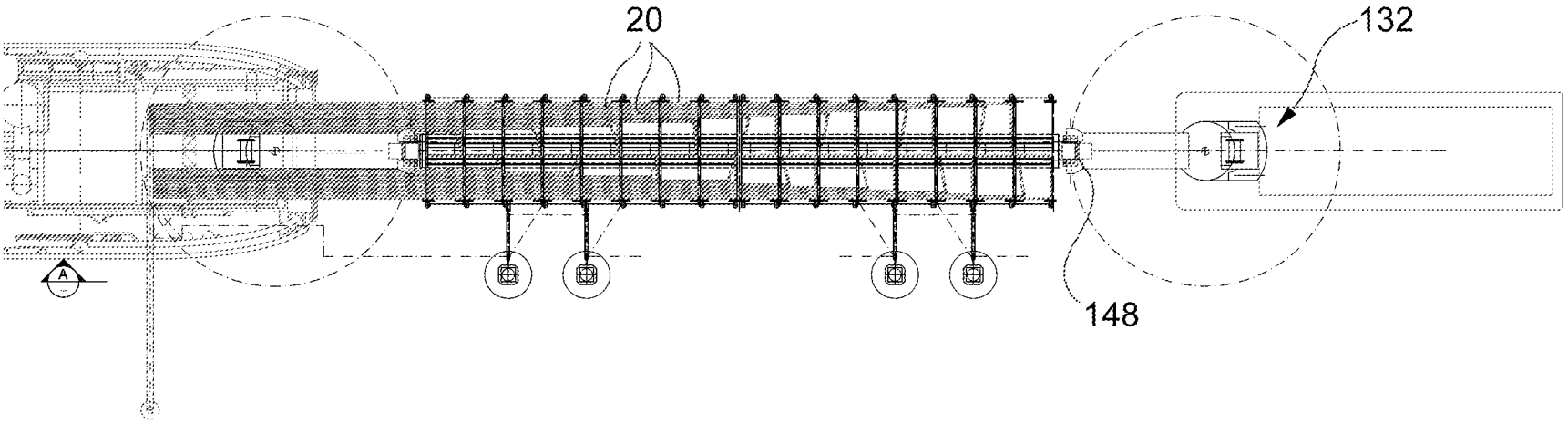
Figure 22:
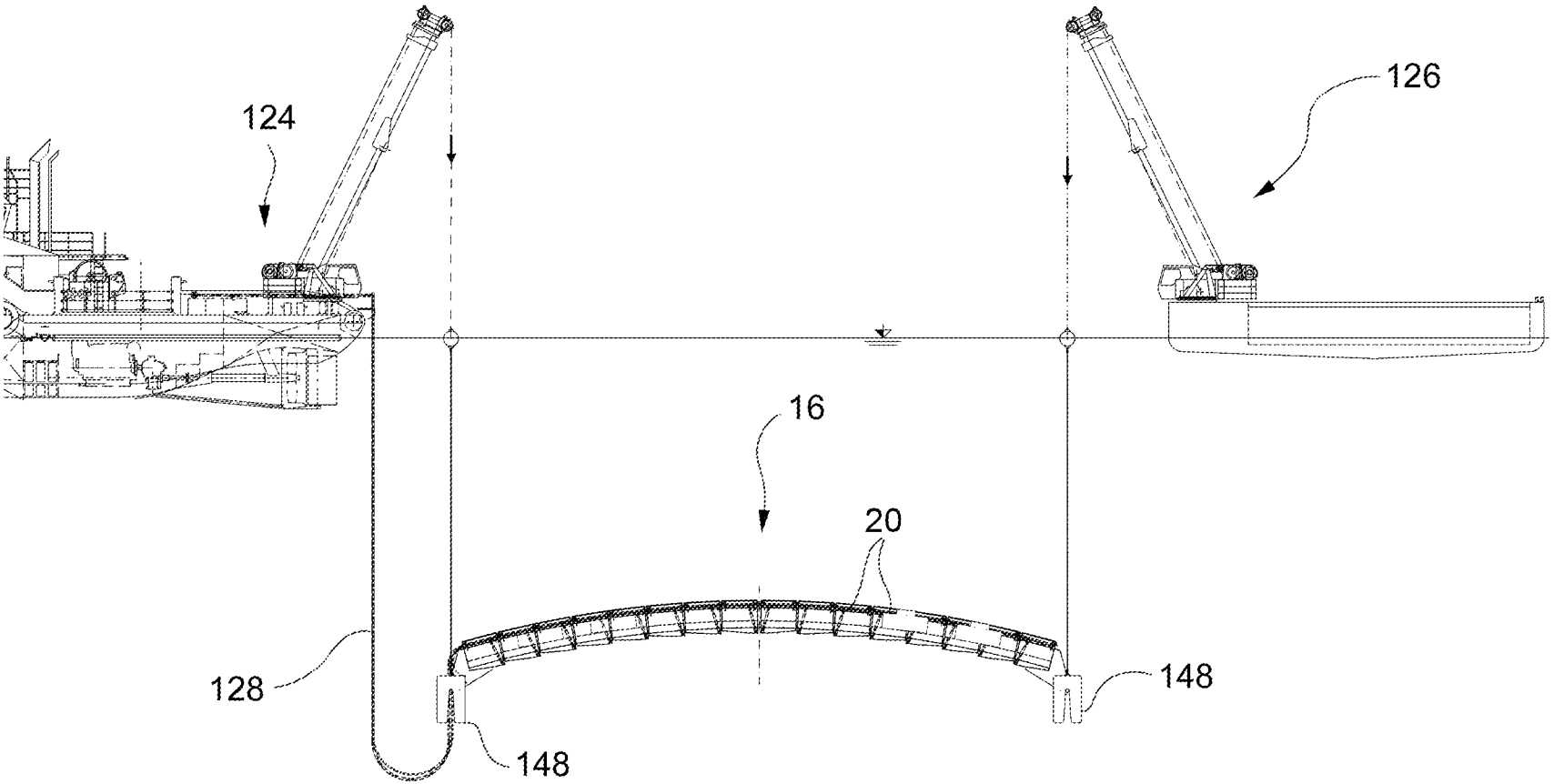
Figure 23:
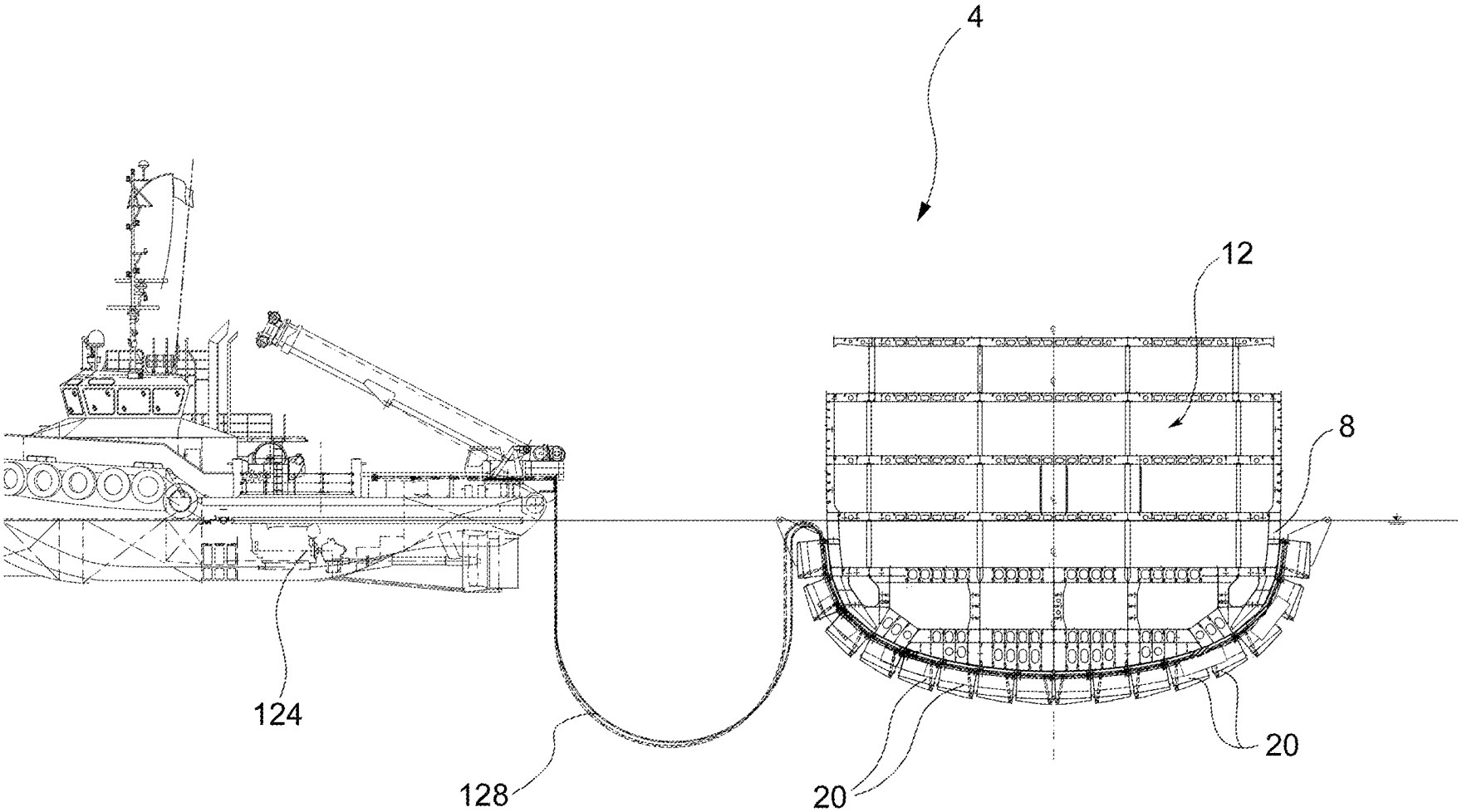
Figure 24:
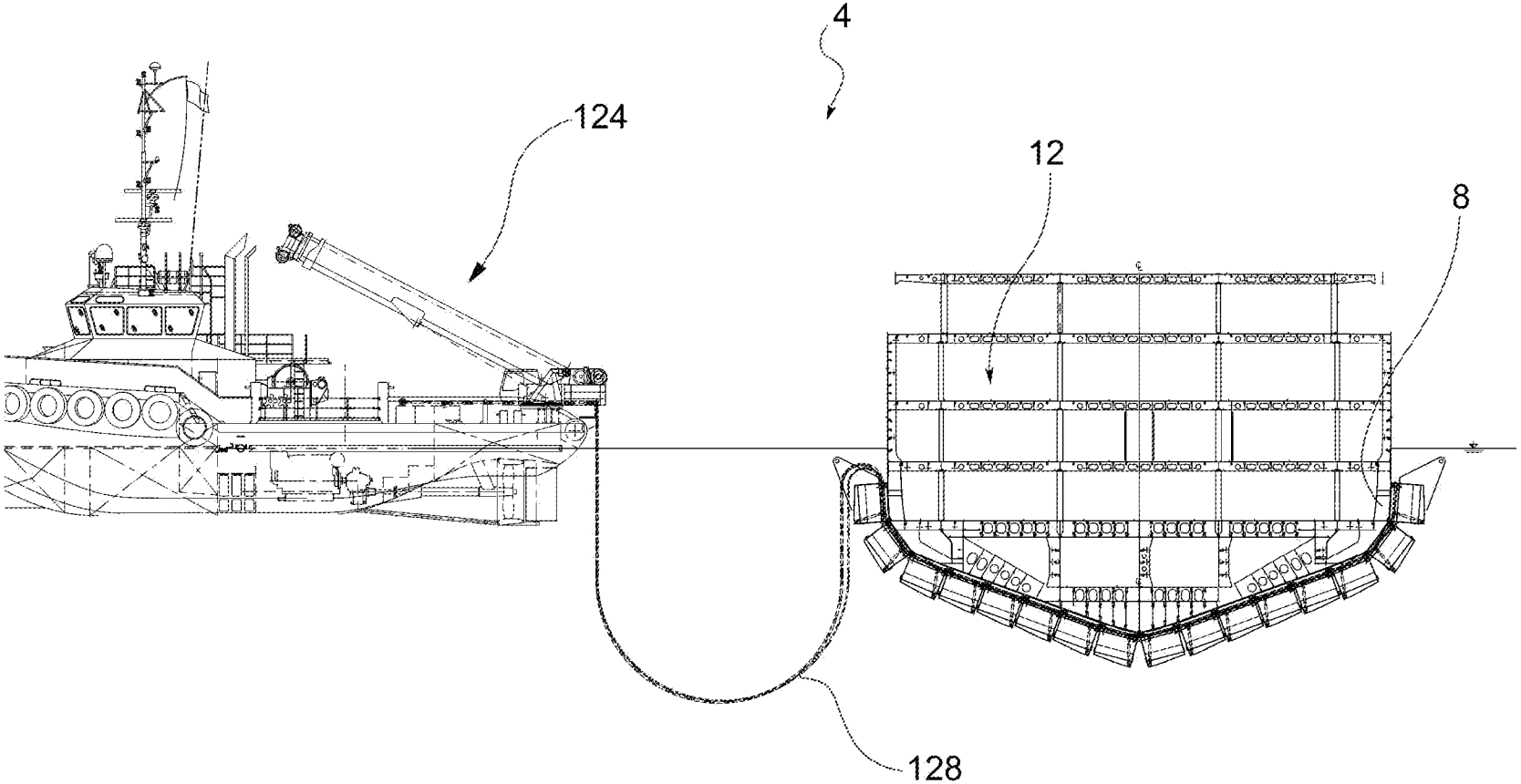
Figure 25:
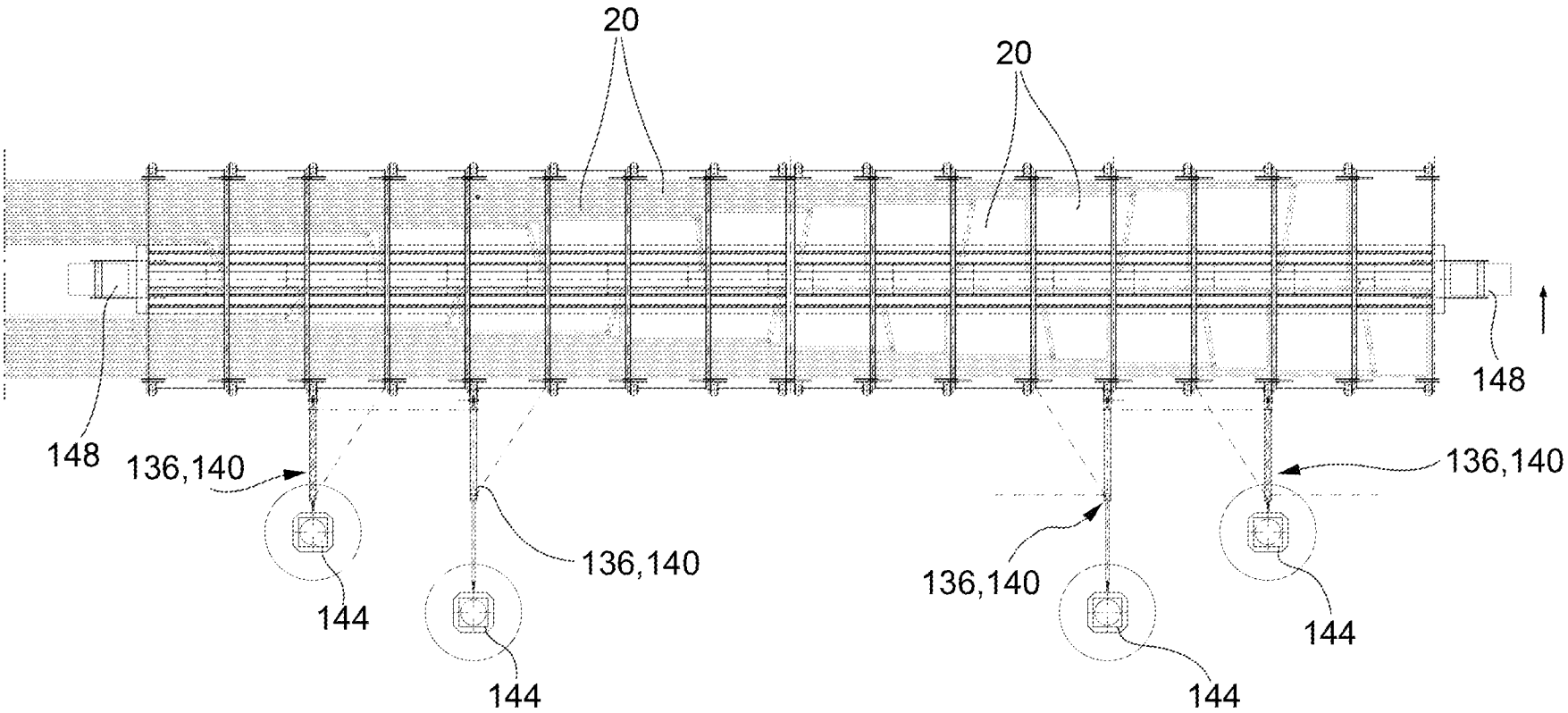
FIG. 25 shows a plan view of the apparatus of FIGS. 20-24.
Figure 26:
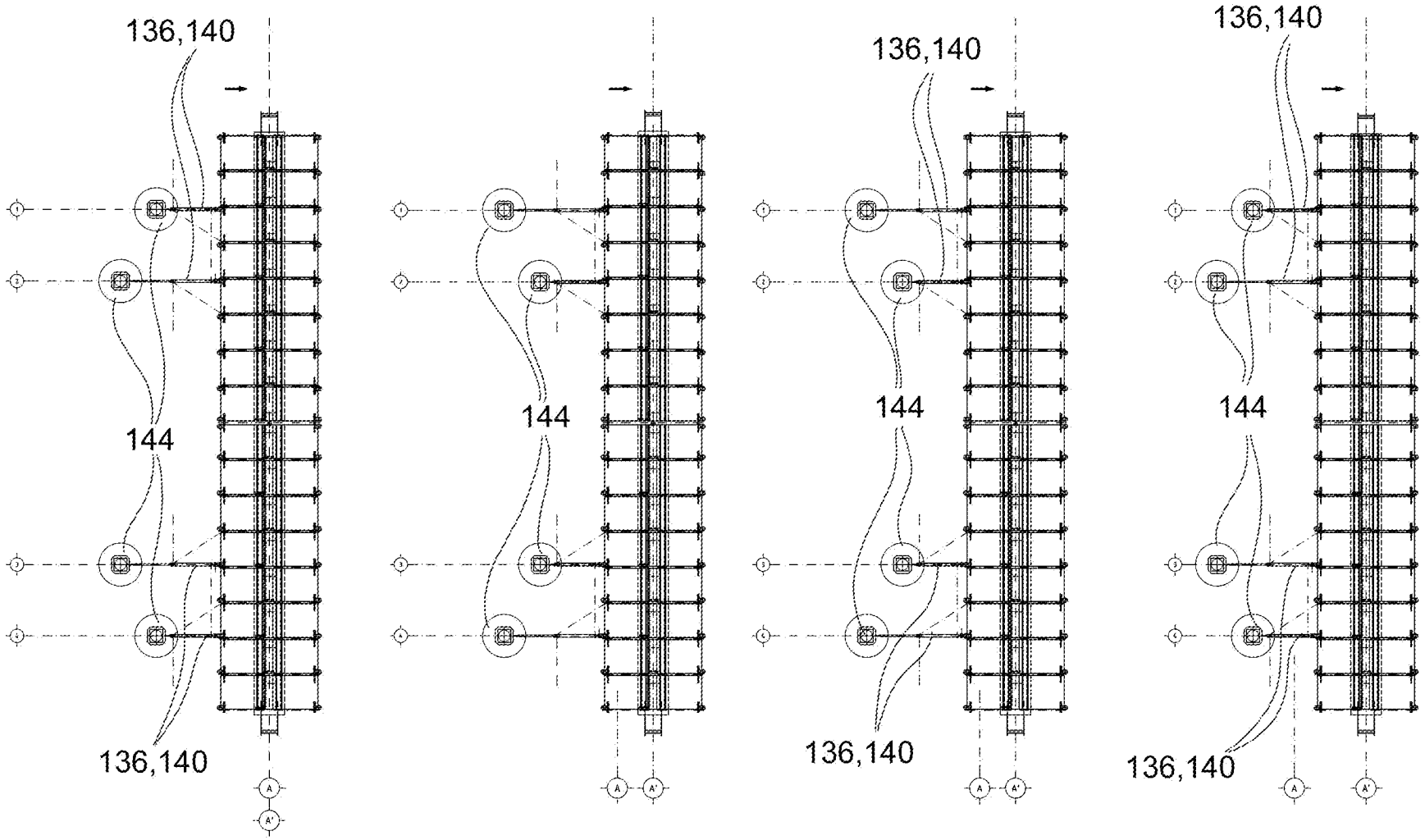
FIG. 26 shows a plan view of the apparatus of FIGS. 20-24 in successive steps of longitudinal advancement with respect to the hull.

Elements or parts of elements common to the embodiments described hereinafter will be indicated with the same numerical references.

DETAILED DESCRIPTION

With reference to the aforesaid figures, the reference numeral 4 globally indicates an apparatus for cleaning the hull 8 of a vessel 12 according to the present invention.

It should be noted that for the purposes of the present invention the materials, dimensions and typology of the vessel and the hull are not relevant, even if, obviously, the invention has a preferred application to larger vessels. Furthermore, the invention finds application on vessels having one or more hulls (for example catamarans, trimarans and the like).

The apparatus 4 for cleaning the hull 8 of a vessel 12 comprises a washing unit 16 having a plurality of washing modules 20 of said hull 8, suitable for washing the hull 8 in a submerged configuration.

Furthermore, the apparatus 4 comprises a service and guidance module 24 for the washing unit 16, which acts as a support, movement and supply of means and services for said washing unit 16, as better described below.

According to a possible embodiment, said service and guidance module 24 comprises a pair of longitudinal guides or supports 28, parallel to each other and to a main longitudinal extension direction Y-Y of the hull 8, so as to be able to guide and/or feed the washing unit 16 during the movement thereof in said main longitudinal extension direction Y-Y.

Preferably, the service and guidance module 24 is provided with propulsion means for moving the service and guidance module 24 and/or the washing unit 16.

According to a possible embodiment, the service and guidance module 24 comprises a turret equipped with at least one crane or winch 32 for handling loads.

The service and guidance module 24 is equipped with a dirty water storage tank 36, fluidically connected to the washing modules 20 and containing the dirt removed from the hull 8 by the washing modules 20.

Preferably, the service and guidance module 24 is provided with a cleaning water storage tank 40, fluidically connected to the washing modules 20 so as to feed pressurized cleaning water to the washing modules 20. The washing pressure may reach up to about 200 bar.

According to a possible embodiment, the service and guidance module 24 is a semi-submersible vessel module configured to position itself under the hull 8 of the vessel 12 to be cleaned.

Preferably, said semi-submersible vessel module comprises a pair of longitudinal submersed tanks, which serve as a dirty water storage tank 36 and cleaning water storage tank 40 so as to serve the washing means with which they are fluidically connected.

As mentioned above, the service and guidance module 24 is operatively connected to the washing modules 20 which interface directly with the hull 8 of the vessel 12 for the relative cleaning.

In particular, according to a possible embodiment, the service and guide module 24 comprises movement means 88 for the washing modules 20. For example, said movement means 88 comprise vertical adjustment cables 26 and longitudinal and/or transversal adjustment cables 27.

In particular, the vertical adjustment cables 26 allow the washing modules 20 to be moved along the vertical direction, so as to allow for example the sinking thereof under the hull 8 and subsequent lifting; the longitudinal and/or transversal adjustment cables 27, on the other hand, allow the washing modules 20 to be firmly fixed to the hull 8 both in the longitudinal direction Y-Y and in the transversal direction X-X. In this way, it is possible to firmly constrain the washing modules 20 to the service and guidance module 24 and to the hull, preventing, for example the wave motion, from causing even violent impacts between the washing modules and the hull 8. At the same time, the longitudinal and/or transversal adjustment cables 27 allow the washing modules 20 to advance along the hull, in the longitudinal direction Y-Y, so as to allow the relative cleaning. Of course, both the vertical adjustment cables 26 and the longitudinal and/or transversal adjustment cables 27 are operationally connected to relative drive winches and/or relative transmissions and drive mechanisms, preferably independent from each other so as to be able to carry out all the maneuvers of displacement and adaptation to the geometry of the hull 8 required by the circumstances and conditions of the sea.

Preferably, the sinking of the washing modules 20 takes place with the aid of suitable ballasts 148.

According to a further embodiment, the service and guidance module 24 comprises a first and a second guide boat 124, 126 arranged on opposite sides of the hull 8 to be cleaned, with respect to a transverse direction X-X.

Said first and second guide boats 124, 126 comprise for example a tugboat and a barge. For example, the first guide boat 124 comprises an umbilical 128 which distributes the pressurized washing water to the washing modules 20. The umbilical 128 is preferably at least 10 m long and is a flexible tube so as to allow a correct safety spacing between the first guide boat 124 and the hull 8 to be cleaned.

Said guide boats 124, 126 may be provided with ballasts suitably maneuvered by service cranes (installed on the guide boats 124, 126 themselves) in order to immerse the washing unit 16 with its washing modules 20 under the hull 8 to be cleaned.

The first boat 124, by means of the umbilical 128, may for example supply pressurized power and oil for the movement of the washing modules 20.

The second guide boat 126 is, for example, fluidically connected to the washing modules 20 so as to be able to receive the so-called fouling, i.e. the water mixed with the dirt removed from the hull 8 which may be stored in a special tank 132.

Each of said guide boats 124, 126 is provided with propulsion means so as to be able to proceed parallel to the longitudinal direction Y-Y dragging the washing unit 16 in said direction during the cleaning of the hull 8. Of course, the advancement movement of the guide boats 124, 126 must be synchronized as much as possible so as to follow the washing unit during the advancement of the latter with respect to the hull 8 along the main longitudinal extension direction Y-Y.

According to an embodiment, the washing modules 20 are provided with means of advancement 136 so as to be able to advance longitudinally with respect to the hull 8.

For example, the means of advancement 136 comprise drive cylinders 140 fitted with a rod 142 which slides at least partially inside said drive cylinders 140 according to an actuation stroke, and at least one electromagnet 144 to enable the means of advancement 136 to be anchored to a wall of the hull 8.

The electromagnet 144, once activated, allows a solid anchoring to the hull 8 of the vessel 12; in this condition, the drive or the exit of the rod 142 from the respective drive cylinder 140 causes the washing module 20 to advance by a stroke equal to at most the extraction stroke of the rod 142.

It is therefore sufficient to command the extraction or retraction of the rod 142 after anchoring the means of advancement 136 to the hull 8 and connect the rod 142 to a portion of the washing modules to obtain the advancement of the washing modules 20 along the longitudinal extension direction Y-Y with respect to the hull 8.

According to a further possible embodiment, the service and guidance module 24 comprises a guide boat 124, 126 and a quay or jetty arranged on opposite sides of the hull 8 to be cleaned, with respect to a transverse direction X-X. It is also possible to use two quays (for example in the case of a navigable canal) or two jetties as support points for the service and guidance module 24.

According to a further possible embodiment, the vessel 12 is provided on board with said cleaning apparatus 4 which may be lowered at the moment of use by means of a crane supplied with the vessel 12 itself or which may also be kept immersed, for example in special housing formed inside the hull 8.

Advantageously, each washing module 20 is equipped with mobile connection means 44 for the mobile mechanical connection of one washing module 20 to an adjacent washing module 20, so as to allow a reciprocal movement between said adjacent washing modules 20 during washing and/or movement.

Preferably, the washing unit 16 comprises a plurality of washing modules 20 associated and arranged together in an arched pattern with an intrados counter-shaped with respect to the hull 8 of the vessel 12 to be cleaned. In other words, the mobile connection means 44, better described below, allow the washing modules 20 to be adapted to the specific geometry, i.e. curvature, of the hull 8 to be cleaned. In fact, the individual washing modules constitute the segments of a broken curved line which is adapted and counter-shaped with respect to the hull 8.

According to a possible embodiment, said mobile connection means 44 comprise hinge means 48 for hinging adjacent washing modules 20.

For example, the hinge means 48 comprise longitudinal hinges or pins 52 extending along a longitudinal rotation axis, parallel to a main longitudinal extension direction Y-Y of the associated hull 8.

Preferably, adjacent washing modules 20 comprise profiles 56 at least partially flared and/or counter-shaped to each other at said mobile connection means 44, so as to allow reciprocal movement around said mobile connection means 44 to assume an arched configuration with an intrados counter-shaped with respect to the hull 8 of the vessel 12 to be cleaned.

Preferably, the mobile connection means 44 are arranged at upper ends 60 of the washing module 20, directly facing the associated hull 8.

According to a further embodiment, at least two washing modules 20 comprise, as mobile connection means 44, vertical hinges or pins 64 extending along a vertical axis of rotation Z-Z, perpendicular to a plane tangential to the washing module 20 and to the hull 8 to which the washing module 20 is applied. The mobile connection means 44 may also comprise spherical hinges and/or cardan joints.

Preferably, adjacent washing modules 20, provided with vertical hinges or pins 64, comprise at least partially flared and/or counter-shaped profiles 56 so as to allow reciprocal rotation around said vertical hinges or pins 64.

Each washing module 20 is in turn provided with washing means 68 of the hull 8 of a vessel 12, suitable for scraping dirt from said hull 8.

The washing means 68 may be of various types.

For example, the washing means 68 comprise pressure water jets.

Preferably, the washing means 68 are arranged at or astride a transverse center plane M-M of each washing module 20, perpendicular to said main longitudinal extension direction Y-Y.

Preferably, each washing module 20 comprises dirt collection means 72.

For example, the dirt collection means 72 comprise a collection chamber 74 delimited by sealing means 76 arranged astride the washing means 20.

The sealing means 76, typically gaskets, serve to isolate the portion of the hull subject to the cleaning action of the washing means 68 so as to confine the dirt removed and prevent it from spreading in an uncontrolled manner.

The washing means 68 may comprise a supply channel of pressurized clean water 80 and a dirty water recovery channel 84.

The dirty water recovery channel 84 is in fluidic connection with the collection chamber 74.

Preferably, the supply channel of pressurized clean water 80 is in fluidic connection with the cleaning water storage tank 40 of the service and guidance module 24.

Preferably, the dirty water recovery channel 84 is in fluidic connection with the dirty water storage tank 36 of the service and guidance module 24.

According to a further embodiment, the washing means 68 comprise rotating brushes (not shown) which carry out cleaning by mechanical abrasion of the hull 8.

The rotating brushes may be provided as an alternative or also alongside the jets of pressurized water.

According to an embodiment of the invention, each washing module 20 is provided with drive means 88 to allow the positioning and movement of the washing module 20 with respect to the hull 8 and/or with respect to other washing modules 20 during the cleaning of the hull 8.

As mentioned above, movement means 88 comprising cables, tow ropes and the like are associated with said washing modules 20 so as to allow the washing modules 20 to be lifted and/or rotated around said mobile connection means 44.

Preferably, the movement means 88 comprise cables or tow ropes joined to each washing module 20 at lower ends 92 of the module itself, opposite the associated vessel 12 and said upper ends 60.

For example, the movement means 88 comprise contact and guide bearings 96 with the hull 8, suitable to allow a reciprocal sliding between the module itself and the hull 8.

The contact and guide bearings 96 may comprise guide rollers with a transverse axis of rotation, perpendicular to the main longitudinal extension direction Y-Y of the hull 8, so as to facilitate the sliding of the washing module 20 on the hull 8 along said main longitudinal extension direction Y-Y.

Preferably, each washing module 20 comprises at least one watertight chamber 100, which may be filled with air, dimensioned so as to provide the relevant washing module 20 with a positive buoyancy thrust that allows it to be stopped in abutment against the hull 8 of the associated vessel 12.

Preferably, the at least one watertight chamber 100 is arranged astride the washing means 68 of each washing module 20, or adjacent thereto.

According to a possible embodiment, said watertight chamber 100 is equipped with control means suitable to allow the at least partial flooding of the watertight chamber 100 or the relative expulsion of water from said watertight chamber 100. In this way, it is possible to modify the overall buoyancy of the washing module 20 according to the required needs.

The operation or the cleaning method carried out by a cleaning apparatus according to the present invention will now be described.

In particular, the washing unit 16 is initially sunk so that it may be positioned under the hull 8 of the vessel 12.

The vessel is anchored or moored beforehand, preferably on the stern side.

The washing unit 16 is then positioned resting on the hull, centered with respect to its own transverse center plane M-M.

According to a possible embodiment, the method proceeds by advancing from bow to stern. In this first step, the cleaning operation is not carried out, but a scan of the geometry/morphology of the hull 8 and also of the degree, type and/or conformation of the dirt present on the hull itself.

Once at the stern, the washing unit 16 goes back towards the bow, carrying out the actual cleaning.

The washing unit 16 may also be provided with video cameras for recording in real time the cleaning operations, for example to allow an external operator to check the occurrence of possible problems. Of course, such shooting and alert operation may be automated.

The process described above obviously applies to any type of service and guidance module 24 employed.

As seen, the cleaning of the hull 8 is carried out keeping the washing unit 16 at a constant distance from the hull 8 both in the vertical direction Z-Z, perpendicular to the waterline of the vessel 12, and in the transverse direction X-X perpendicular to the vertical direction Z-Z and the main longitudinal extension direction Y-Y of the vessel 8.

The method may also comprise the step of monitoring and controlling the position of the washing unit 16 with respect to the hull 8 of the vessel 12 by means of position sensors and/or GPS and/or laser and/or ecoscanner technologies.

As may be seen from the above description, the cleaning apparatus according to the invention allows the drawbacks of the prior art to be overcome.

In particular, the present invention allows cleaning of the hull to be carried out relatively quickly, without the use of divers.

Cleaning is complete and effective and also does not involve any dispersion of the material detached from the hull, so it does not involve any environmental pollution.

The cleaning operation does not cause any damage to the hull because the cleaning apparatus is relatively light and able to remain adherent to the hull without damaging it in any way, even in the event of wave motion. In fact, the washing modules are anchored to the hull in a vertical and transverse direction and are gradually towed in the longitudinal direction to clean the hull. In this way, even in the presence of wave motion, there are no dangerous collisions between the washing modules and the hull itself.

Furthermore, the present invention provides for the implementation of an apparatus of considerably reduced dimensions and weights with respect to known solutions.

By virtue of the fact that the dimensions and the weight are contained, the handling costs of the apparatus and the overall times of the cleaning operation are also reduced.

Advantageously, the apparatus according to the present invention is capable of carrying out the cleaning of the boat even in the harbor, exploiting the waiting times of the vessel, such as, for example, waiting for passage in the Panama Canal. In this way, considerable time savings and cost optimization are achieved.

Washing is carried out with pressurized water jets and the dirt collected directly by the washing modules and conveyed to a special collection chamber.

A person skilled in the art may make several changes and adjustments to the cleaning apparatus and methods described above in order to meet specific and incidental needs, all falling within the scope of protection defined in the following claims.

The invention claimed is:

1. An apparatus for cleaning a hull of a vessel comprising a washing unit having a plurality of washing modules for washing the hull in a submerged configuration, wherein each washing module is equipped with mobile connectors for the mobile mechanical connection of one washing module to an adjacent washing module, to allow a reciprocal movement between said adjacent washing modules during washing and/or movement, each washing module having washers of the hull for scraping dirt from said hull, each washing module being equipped with drivers to allow positioning and movement of the washing module with respect to the hull and/or with respect to other washing modules during the cleaning of the hull;

wherein each washing module comprises at least one watertight chamber, which are fillable with air, dimensioned so as to provide the relevant washing module with a positive buoyancy thrust that allows the relevant washing module to be stopped in abutment against the hull of the associated vessel; and wherein said watertight chamber is equipped with a controller to allow the at least partial flooding of the watertight chamber or expulsion of water from the watertight chamber.

2. The apparatus for cleaning the hull of a vessel according to claim 1, wherein the washing unit comprises a plurality of washing modules associated and arranged in an arched pattern with an intrados counter-shaped with respect to the hull of the vessel to be cleaned.

3. The apparatus for cleaning the hull of a vessel according to claim 1, wherein said mobile connectors comprise hinges for hinging adjacent washing modules.

4. The apparatus for cleaning the hull of a vessel according to claim 3, wherein said hinges comprise longitudinal hinges or pins extending along a longitudinal rotation axis, parallel to a main longitudinal extension direction of the associated hull.

5. The apparatus for cleaning the hull of a vessel according to claim 1, wherein adjacent washing modules comprise profiles at least partially flared and/or counter-shaped to each other at said mobile connectors, to allow reciprocal movement around said mobile connectors to assume a straight and/or curved arched configuration with an intrados counter-shaped with respect to the hull of the vessel to be cleaned.

6. The apparatus for cleaning the hull of a vessel according to claim 1, wherein said mobile connectors are arranged at upper ends of the washing module, directly facing the associated hull.

7. The apparatus for cleaning the hull of a vessel according to claim 1, wherein at least two washing modules comprise, as mobile connectors, vertical hinges or pins extending along a vertical axis of rotation, perpendicular to a plane tangential to the washing module and to the hull to which the washing module is applied.

8. The apparatus for cleaning the hull of a vessel according to claim 7, wherein adjacent washing modules with vertical hinges or pins comprise profiles at least partially flared and/or counter-shaped to each other to allow reciprocal rotation between the washing modules around said vertical hinges or pins.

9. The apparatus for cleaning the hull of a vessel according to claim 1, wherein said washing modules are associated with drivers comprising cables, ropes, tow ropes to allow the lifting and/or rotation of the washing modules around said mobile connectors.

10. The apparatus for cleaning the hull of a vessel according to claim 9, wherein said drivers comprise cables or tow ropes joined to each washing module at the lower ends, opposite the associated vessel.

11. The apparatus for cleaning the hull of a vessel according to claim 9, wherein the drivers comprise vertical adjustment cables and/or longitudinal and/or transversal adjustment cables, wherein the vertical adjustment cables allow the movement of the washing modules along a vertical or sinking direction, to allow sinking to below the hull and subsequent lifting, and wherein the longitudinal and/or transversal adjustment cables allow the washing modules to be firmly attached to the service and guidance module in both longitudinal and transverse directions.

12. The apparatus for cleaning the hull of a vessel according to claim 1, wherein said drivers comprise contact and guide bearings with the hull, allowing a reciprocal sliding between the cleaning module and the hull.

13. The apparatus for cleaning the hull of a vessel according to claim 12, wherein said contact and guide bearings comprise guide rollers with a transverse axis of rotation, perpendicular to a main longitudinal extension direction of the hull, so as to facilitate the sliding of the washing module on the hull along said main longitudinal extension direction.

14. The apparatus for cleaning the hull of a vessel according to claim 1, wherein said at least one watertight chamber is arranged astride the washers of each washing module, or adjacent the washers of each washing module.

15. The apparatus for cleaning the hull of a vessel according to claim 1, wherein the washers comprise pressure water jets.

16. The apparatus for cleaning the hull of a vessel according to claim 1, wherein the washers are arranged at or astride a transverse centre plane of each washing module, perpendicular to said main longitudinal extension direction.

17. The apparatus for cleaning the hull of a vessel according to claim 1, wherein each washing module comprises dirt collectors.

18. Method for cleaning the hull of a vessel comprising the steps of:

providing a cleaning apparatus according to claim 1, bringing said cleaning apparatus to an operative distance from the hull and proceeding with cleaning using said washing modules brought into a working range with the hull;

performing the cleaning of the hull keeping the washing modules at a working distance from the hull by monitoring and controlling position and distance of the washing unit with respect to the hull of the vessel by position sensors and/or global position system (GPS) and/or laser and/or ecoscanner technologies, and/or by monitoring sliding systems in contact with the hull of the vessel.

* * * * *